US008124308B2

(12) United States Patent
Watanabe et al.

(10) Patent No.: US 8,124,308 B2
(45) Date of Patent: Feb. 28, 2012

(54) TONER, VESSEL WITH THE TONER, DEVELOPER, IMAGE FORMING APPARATUS AND PROCESS CARTRIDGE AND IMAGE FORMING METHOD

(75) Inventors: Naohiro Watanabe, Shizuoka (JP); Shigeru Emoto, Numazu (JP); Yohichiroh Watanabe, Fuji (JP); Masahide Yamada, Numazu (JP); Tsunemi Sugiyama, Kashiwa (JP); Masahiro Ohki, Iruma (JP); Akinori Saitoh, Numazu (JP); Ryota Inoue, Mishima (JP); Osamu Uchinokura, Mishima (JP); Junichi Awamura, Numazu (JP)

(73) Assignee: Ricoh Company. Ltd., Tokyo (JP)

( * ) Notice: Subject to any disclaimer, the term of this patent is extended or adjusted under 35 U.S.C. 154(b) by 0 days.

(21) Appl. No.: 12/966,193

(22) Filed: Dec. 13, 2010

(65) Prior Publication Data

US 2011/0086308 A1 Apr. 14, 2011

Related U.S. Application Data

(62) Division of application No. 12/282,075, filed as application No. PCT/JP2007/054748 on Mar. 5, 2007, now Pat. No. 8,026,031.

(30) Foreign Application Priority Data

Mar. 6, 2006 (JP) ..... 2006-058825

(51) Int. Cl.
*G03G 9/08* (2006.01)

(52) U.S. Cl. ..... 430/137.14; 430/137.15

(58) Field of Classification Search ..... 430/137.14, 430/137.15

See application file for complete search history.

(56) References Cited

U.S. PATENT DOCUMENTS

| | | | | |
|---|---|---|---|---|
| 7,309,558 | B1 | 12/2007 | Michel et al. | |
| 2002/0058739 | A1 | 5/2002 | Lorah et al. | |
| 2005/0003291 | A1* | 1/2005 | Takada et al. | 430/111.4 |
| 2005/0079433 | A1 | 4/2005 | Watanabe et al. | |
| 2005/0089787 | A1* | 4/2005 | Uchinokura et al. | 430/124 |
| 2005/0112488 | A1* | 5/2005 | Yamada et al. | 430/108.7 |
| 2005/0186498 | A1 | 8/2005 | Honda et al. | |
| 2005/0277040 | A1 | 12/2005 | Michel et al. | |
| 2006/0020069 | A1 | 1/2006 | Michel et al. | |
| 2006/0216629 | A1 | 9/2006 | Miyakawa et al. | |

FOREIGN PATENT DOCUMENTS

| | | |
|---|---|---|
| JP | 62 266550 | 11/1987 |
| JP | 2 51164 | 2/1990 |
| JP | 4 313761 | 11/1992 |
| JP | 5 66600 | 3/1993 |
| JP | 8 6295 | 1/1996 |
| JP | 8 211655 | 8/1996 |
| JP | 10 20552 | 1/1998 |
| JP | 11 7156 | 1/1999 |
| JP | 2003 515795 | 5/2003 |
| JP | 2003 202708 | 7/2003 |
| JP | 2005 234274 | 9/2005 |
| JP | 2006 17781 | 1/2006 |
| JP | 2006 500605 | 1/2006 |
| JP | 2006 503313 | 1/2006 |
| JP | 2006 267911 | 10/2006 |
| KR | 2002-0060241 | 7/2002 |
| WO | 01 40878 | 6/2001 |
| WO | WO 2006/014019 A1 | 2/2006 |

OTHER PUBLICATIONS

English language machine translation of JP 08-006295, Jan. 1996.
English language machine translation of JP 2003-202708, Jul. 2003.
English language machine translation of JP 2006-267911, Oct. 2006.
European Search Report issued Aug. 3, 2011, in Patent Application No. 07738233.1.
Chinese Office Action issued on Dec. 1, 2010 in corresponding Chinese Application No. 200780015738.3 (with an English Translation).

* cited by examiner

*Primary Examiner* — Hoa Le
(74) *Attorney, Agent, or Firm* — Oblon, Spivak, McClelland, Maier & Neustadt, L.L.P.

(57) ABSTRACT

Toner and a developer which are excellent in cleaning property and fixing property at low temperature, and capable of forming images with high quality are provided, along with a method for their production. A toner producing method involves dispersing and/or emulsifying an oil phase or a monomer phase containing a toner composition and/or a toner composition precursor in a water-based medium to granulate,
wherein the toner has an average circularity of 0.925 to 0.970, and the toner composition and/or the toner composition precursor has a layered inorganic material in which at least a part of interlayer ions in the layered inorganic material has been exchanged with organic ions.

20 Claims, No Drawings

TONER, VESSEL WITH THE TONER, DEVELOPER, IMAGE FORMING APPARATUS AND PROCESS CARTRIDGE AND IMAGE FORMING METHOD

CROSS-REFERENCE TO RELATED APPLICATIONS

The present application is a Divisional of U.S. application Ser. No. 12/282,075, filed Sep. 25, 2008 now U.S. Pat. No. 8,026,031, pending, which was a 371 of PCT/JP07/54748, filed Mar. 5, 2007; and claims priority to Japanese application JP 2006-058825, filed Mar. 6, 2006, the entire contents of each of which are hereby incorporated by reference.

TECHNICAL FIELD

The present invention relates to toner used in a developer for developing an electrostatic charge image in electrographs, electrostatic records and electrostatic printings, and an electrograph developing apparatus using the toner. More particularly, the present invention relates to toner for electrographs used for copying machines, laser printers and plain paper facsimiles using a direct or indirect electrograph developing system, and an image forming method.

BACKGROUND ART

In one example of electrographic methods, a latent electrostatic image is formed on an image bearing member by electrical charge and exposure, and subsequently developed by a toner-containing developer to form a toner image. Further, the toner image is transferred onto a recording material and then fixed. Meanwhile, the remaining toner on the image bearing member, which has not been transferred onto the recording material is cleaned by a cleaning member such as a blade disposed by welding with pressure on the surface of the image bearing member.

As a method for producing the toner, a pulverization method is known. The pulverization method is a method for producing the toner by melting and kneading one obtained by adding a colorant, and additives used if necessary to a thermoplastic resin as a binding resin, and subsequently pulverizing and classifying. However, the toner obtained in this way has large particle sizes, and it is difficult to form high-definition images using such toner.

Thus, the methods for producing the toner using a polymerization method or an emulsification dispersion method are known. As the polymerization method, a suspension polymerization method in which a monomer, a polymerization initiator, the colorant and a charge controlling agent are added in a water-based medium containing a dispersant with stirring to form oil droplets and then the polymerization is performed is known. An association method of agglutinating and fusion-bonding the particles obtained using the emulsification polymerization and the suspension polymerization is also known.

However, in these methods, although the particle diameter of the toner can be reduced, it is not possible to produce the toner containing a polyester resin or epoxy resin suitable for color toner as a major component of the binding resin because the major component in the binding resin is limited to a polymer obtained by radical polymerization.

Thus, the method for producing the toner using the emulsification dispersion method in which a mixture of the binding resin, colorant and the like is mixed with the water-based medium to emulsify is known (see Japanese Patent Application Laid-Open (JP-A) No. 05-666000 and JP-A No. 08-211655). This can reduce the particle diameter of the toner and additionally expands a range of choice for the binding resin. However, when such a method is used, fine particles are produced and emulsification loss occurs.

Thus, the method for producing the toner by emulsifying and dispersing the polyester resin and subsequently agglutinating and fusion-bonding the resulting particles is known (see JP-A No. 10-020552 and JP-A No. 11-007156). This can inhibit occurrence of the fine particles and reduce the emulsification loss.

However, the toner obtained by using the polymerization method or the emulsification method tends to become a spherical shape due to an interface tension of the liquid drops produced in a dispersion step. Thus, there is a problem that when a blade cleaning system is used, the spherical toner is hardly cleaned because the spherical toner rotates between a cleaning blade and a photoconductor to enter in spaces.

Thus, the method of making the particles amorphous by performing a stirring at high speed before termination of the polymerization to add a mechanical force to the particles is known (see JP-A No. 62-566560). However, when such a method is used, there is a problem that a dispersion state becomes unstable and the particles are easily integrated one another.

The method for obtaining association particles having the particle diameters of 5 to 25 μm by using polyvinyl alcohol having a particular saponification degree as the dispersant and agglutinating the particles is also known (see JP-A No. 02-51164). However, there is a problem that the association particle obtained in this way easily has the large particle diameter.

The method for making the particle amorphous by adding a filler together with a toner composition to an organic solvent is also known (see JP-A No. 02-51164). However, when the filler is added to the toner, a viscoelasticity of the toner is increased and a lower limit of the fixing is inhibited. When the filler is present on the toner surface, the viscoelasticity of the toner is scarcely increased, but when the substance such as filler is present in a toner surface layer, permeation of wax and melting out of the binding resin are inhibited as well as the fixing property at constant temperature and hot offset property are also inhibited.

Furthermore, a charge controlling agent obtained by exchanging ions such as metal ions present in an interlayer of a layered inorganic material with organic ions has been developed, and it has been proposed to use this for the toner for electrographs (see JP-A No. 2003-515795, JP-A No. 2006-50605, JP-A No. 2006-503313, JP-A No. 2003-202708, JP-A No. 2006-267911).

The toner for electrographs produced by a phase inversion method has been proposed (see JP-A No. 2006-267911). When the layered inorganic material exchanged with the organic ion is used for the toner electrographs produced by the phase inversion method, it is not sufficient as the charge controlling agent and the shape also becomes spherical. Although a reason is unknown, it is thought that the layered inorganic material exchanged with the organic ion is relatively evenly present in the vicinity of the aqueous phase before the phase inversion, but no uniform particle is made upon phase inversion, the layered inorganic material is unevenly present on the surface of toner particles and this is due to its unevenness.

DISCLOSURE OF INVENTION

Problems of the present invention are as follows.

(1) Toner and an image forming apparatus capable of obtaining an image quality which is excellent in fine dot reproducibility and is of high grade are provided.

(2) Toner and an image forming apparatus capable of obtaining high reliability particularly in cleaning are provided.

(3) Toner and an image forming apparatus having an excellent fixing property at low temperature are provided.

(4) Toner and an image forming apparatus which can accomplish the problems of (1) to (3) equivalently are provided.

(5) Dry toner and an image forming apparatus which are excellent in transfer efficiency and reduces an amount of the remaining toner after transfer, and by which an image of high grade can be obtained are provided.

(6) Oilless dry toner which balances a charge stability and a fixing property at low temperature is provided.

(7) Novel toner using power consumption at low level, and which balances a high transfer property required for a color image and an OHP permeability at high dimension is provided The present inventors led to the completion of the present invention to solve the aforementioned problems. That is, according to the present invention, toners, methods and apparatuses for forming the images shown below are provided.

(1) A toner prepared by dispersing and/or emulsifying an oil phase or a monomer phase comprising a toner composition and/or a toner composition precursor in a water-based medium to granulate, wherein the toner has an average circularity of 0.925 to 0.970, and the toner composition and/or the toner composition precursor has a layered inorganic material in which at least a part of interlayer ions in the layered inorganic material has been exchanged with organic ions.

(2) A toner prepared by dispersing and/or emulsifying an oil phase comprising toner composition and/or a toner composition precursor or a monomer phase, in a water-based medium to granulate, wherein the toner has an average circularity of 0.925 to 0.970, and said toner composition and/or the toner composition precursor has a layered inorganic material in which at least a part of interlayer ions in the layered inorganic material has been exchanged with organic ion.

(3) The toner according to (1) or (2) above, wherein said exchanged layered inorganic material is a layered inorganic material in which at least a part of interlayer ions in the layered inorganic material has been exchanged with organic cations.

(4) The toner according to any one of (1) to (3) above, wherein said toner is prepared by an oil phase which is a solution and/or a dispersion in which the toner composition and/or the toner composition precursor comprising a binding resin and/or a binding resin precursor has been dissolved and/or dispersed.

(5) The toner according to any one of (1) to (4) above, wherein the binding resin contained in said toner contains at least two types of binding resins.

(6) The toner according to any one of (1) to (5) above, wherein a first binding resin contained in said binding resin is a resin having a polyester skeleton.

(7) The toner according to any one of (1) to (6) above, wherein the first binding resin is a polyester resin.

(8) The toner according to any one of (1) to (7) above, wherein said polyester resin is an unmodified polyester resin.

(9) The toner according to any one of (1) to (8) above, wherein said binding resin precursor is a modified polyester based resin.

(10) The toner according to any one of (1) to (9) above, obtained by dissolving or dispersing at least said first binding resin, said binding resin precursor, a compound extended or crosslinked with said binding resin precursor, a colorant, a releasing agent and said exchanged layered inorganic material in an organic solvent, crosslinking and/or extending the solution or the dispersion in a water-based medium, and removing the solvent from a resulting dispersion.

(11) The toner according to any one of (1) to (10) above, wherein a ratio (Dv/Dn) of a volume average particle diameter (Dv) to a number average particle diameter (Dn) is 1.00 to 1.30 and a circularity is 0.950 or less in the toner comprise 20% to 80% of entire toner particles.

(12) The toner according to any one of (1) to (11) above, wherein the layered inorganic material exchanged with the organic ion is contained at 0.05% to 10% in a solid content in the solution or dispersion described above.

(13) The toner according to any one of (1) to (12) above, wherein the ratio of the volume average particle diameter (Dv) to the number average particle diameter (Dn) in the toner is 1.20 or less.

(14) The toner according to any one of (1) to (13) above, wherein the particles of 2 μm or less in the toner is 1% by number to 20% by number.

(15) The toner according to any one of (1) to (14) above, wherein a content of a polyester resin component contained in said binding resin is 50% by weight to 100% by weight

(16) The toner according to any one of (1) to (15) above, wherein a weight average molecular weight of a THF soluble fraction of said polyester resin component is 1,000 to 30,000.

(17) The toner according to any one of (1) to (16) above, wherein an acid value of said first binding resin is 1.0 (KOH mg/g) to 50.0 (KOH mg/g).

(18) The toner according to any one of (1) to (17) above, wherein a glass transition point of said first binding resin is 35° C. to 65° C.

(19) The toner according to any one of (1) to (18) above, wherein said binding resin precursor has a site capable of reacting with a compound having an active hydrogen group and the weight average molecular weight of a polymer of said binding resin precursor is 3,000 to 20,000.

(20) The toner according to any one of (1) to (19) above, wherein the acid value of the toner is 0.5 (KOH mg/g) to 40.0 (KOH mg/g).

(21) The toner according to any one of (1) to (20) above, wherein the glass transition point of the toner is 40° C. to 70° C.

(22) The toner according to any one of (1) to (21) above, wherein the toner is used for a two-component developer.

(23) A vessel with a toner, wherein the vessel has the toner according to any one of (1) to (22) above.

(24) A developer, wherein the developer contains the toner according to any one of (1) to (23) above.

(25) An image forming apparatus, wherein an image is formed using the developer according to (24).

(26) A process cartridge having a developing unit and an image bearing member, wherein the developing unit has the developer according to (24).

(27) An image forming method, wherein an image is formed using the developer according to (24).

(28) A method for producing toner, wherein an oil phase and/or a monomer phase containing a toner composition and/or the toner composition precursor having a exchanged layered inorganic material wherein at least a part of interlayer ions in the layered inorganic material has been exchanged with organic ions is dispersed and/or emulsified in a water-based medium to granulate to have an average circularity of 0.925 to 0.970.

(29) The method for producing the toner according to (28), wherein powder having the average circularity of 0.925 to 0.970 is obtained by dissolving or dispersing at least a binding resin, a precursor of the binding resin, a compound extended or crosslinked with the binding resin precursor, a colorant, a releasing agent and the exchanged layered inorganic material in an organic solvent, crosslinking and/or extending the solution or the dispersion in a water-based medium, and removing the solvent from a resulting dispersion.

(30) The method for producing the toner according to (28) or (29), wherein the toner composition contains at least two types of the binding resins.

(31) The method for producing the toner according to (29), wherein the first binding resin in the binding resin is a resin having a polyester skeleton.

(32) The method for producing the toner according to (30), wherein the first binding resin is a polyester resin.

BEST MODE FOR CARRYING OUT THE INVENTION

An average circularity of the toner of the present invention is preferably 0.925 to 0.970 and more preferably 0.945 to 0.965. The circularity is represented by a value obtained by dividing a circumference length of a circle which has an area equal to a projected area of a sample by a circumference length of the sample. It is preferable that a content of particles having the circularity of less than 0.925 in the toner is 15% or less. When the average circularity is less than 0.925, a satisfactory transfer property and a high definition image with no dust are not obtained in some cases. When it exceeds 0.970, a photoconductor and a transfer belt are not successfully cleaned and stains on the image occurs in some cases in an image forming apparatus employing blade cleaning. For example, when the image such as photograph image having a high image area rate is formed, the toner which has formed a non-transferred image due to paper supply defect is accumulated on the photoconductor to cause scumming on the image or contaminate an electrical charge roller which charges the photoconductor in contact, leading to being incapable of exerting original charging capacity.

The average circularity can be measured by technique of optical detection zone which passes a suspension containing the toner through an image pickup section detection zone on a flat plate, optically detects a particle image by CCD camera and analyzes, and can be measured using a flow type particle image analysis apparatus FPIA-2100 (supplied from Sysmex).

Subsequently, a exchanged layered inorganic material used in the present invention will be described.

The layered inorganic material refers to an inorganic mineral formed by overlaying layers with a thickness of several nm, and its exchange refers to that organic ions are introduced into ions present in an interlayer thereof. Specifically, it is described in the above JP-A No. 2006-500605, JP-A No. 2006-503313 and JP-A No. 2003-202708. This is referred to as intercalation in a broad sense. As the layered inorganic material, smectite group (montmorillonite, saponite and the like), kaolin group (kaolinite and the like), magadiite and kanemite are known. The exchanged layered inorganic material is highly hydrophilic due to its exchanged layered structure. Thus, if the layered inorganic material without exchanging is dispersed in the water-based medium to use for the toner to be granulated, the layered inorganic material migrates into the water-based medium and the toner can not be altered in shape. However, by exchanging with the organic ion, the appropriate hydrophobicity appears, the exchanged layered inorganic material is abundantly present in the vicinity of the toner particle surface, and the toner is easily altered in shape upon granulation, dispersed to become fine powders and sufficiently exerts a charge control function. The layered inorganic material scarcely contributes to the fixing property at low temperature of the toner. Thus, when it abundantly present in the toner surface portion, it is thought that the fixing at low temperature is inhibited. However, since the exchanged layered inorganic material in an extremely small amount exerts the shape alteration and charge controlling functions, it becomes possible to balance the shape control, the charge controlling function and the fixing at low temperature.

The exchanged layered inorganic material used in the present invention is desirably one obtained by exchanging one having a smectite-based basic crystal structure with the organic cation. The smectite clay mineral charges a negative charge in the layer and the cation is present in the interlayer to compensate this. An interlayer compound can be formed by ion exchange of this cation and absorption of polar molecules. The metal ion can be introduced by substituting a part of the bivalent metal in the layered inorganic material with the trivalent metal. However, when the metal ion is introduced, the hydrophilicity becomes high. Thus, the layered inorganic material obtained by exchanging at least a part of the metal ions with the organic anions is desirable. This makes it have the appropriate hydrophobicity.

In the layered inorganic material in which at least a part of ions in the layered inorganic material has been exchanged with the organic ions, an organic ion exchanging agent includes quaternary alkyl ammonium salts, phosphonium salts and imidazolium salts, and quaternary alkyl ammonium salts are desirable. The quaternary alkyl ammonium includes trimethylstearyl ammonium, dimethylstearylbenzyl ammonium, dimethyloctadecyl ammonium and oleylbis(2-hydroxyethyl)methyl ammonium.

As the exchanged layered inorganic material, it is possible to use kaolinite, layered phosphate salts and layered double hydroxide. In this case, as the exchanging agent, the organic ion exchanging agent can be appropriately selected depending on phase charge. When the layer is negatively charged, the above organic ion exchanging agents are included. When the layer is positively charged, the organic ion exchanging agent includes sulfate salts, sulfonate salts, carboxylate salts or phosphate salts having branched, non-branched or cyclic alkyl (C1 to C44), alkynyl (C1 to C22), alkoxy (C8 to C32), hydroxyalkyl (C2 to C22), ethylene oxide and propylene oxide. Carboxylic acid having an ethylene oxide skeleton is desirable.

By exchanging at least a part of the layered inorganic material with the organic ion, the toner has the appropriate hydrophobicity, the oil phase comprising the toner composition and/or the toner composition precursor has a non-Newtonian viscosity and the toner can be altered in shape. At that time, the content of the exchanged layered inorganic material in which the part has been exchanged with organic ions is preferably 0.05% by weight to 10% by weight and more preferably 0.05% by weight to 5% by weight in the toner material. Here, the "toner composition refers to various materials which compose the toner, and the "toner composition precursor" refers to substances/materials which become the materials which compose the toner by reaction.

The exchanged layered inorganic material in which the part has been exchanged with organic ions can be appropriately selected, and includes montmorillonite, bentonite, hectorite, attapulgite, sepiolite and mixtures thereof. Among them, organically exchanged montmorillonite or bentonite is preferable because it does not affect toner properties, the viscosity can be easily controlled and an amount thereof to be added can be small.

Commercially available products of the layered inorganic material in which the part has been exchanged with the organic cation include quaternium 18 bentonite such as Bentone 3, Bentone 38, Bentone 38V (supplied from Rheox), Tixogel VP (supplied from United Catalyst), Clayton 34, Clayton 40, Clayton XL (supplied from Southern Clay); stearalconium bentonite such as Bentone 27 (supplied from Rheox), Tixogel LG (supplied from United Catalyst), Clayton AF, Clayton APA (supplied from Southern Clay); and quaternium 18/benzalkonium bentonite such as Clayton HT and Clayton PS (supplied from Southern Clay). Clayton AF and Clayton APA are particularly preferable. As the layered inorganic material in which the part has been exchanged with the organic anions, those obtained by modifying DHT-4A (supplied from Kyowa Chemical Industry Co., Ltd.) with the organic anions represented by the following general formula (1) are particularly preferable. The following general formula includes, for example Hitenol 330T (supplied from Daiichi Kogyo Seiyaku Co., Ltd.).

$$:R_1(OR_2)_nOSO_3M: \qquad \text{General formula (1)}$$

wherein $R_1$ represents an alkyl group having 13 carbon atoms, $R_2$ represents an alkylene group having 2 to 6 carbon atoms, n represents an integer of 2 to 10, and M represents a monovalent metal element.

By using the exchanged layered inorganic material, it is possible to have the appropriate hydrophobicity, make the oil phase comprising the toner composition and/or the toner composition precursor have the non-Newtonian viscosity in the process for producing the toner and alter the toner in shape.

In the toner of the present invention, the ratio (Dv/Dn) of the volume average particle diameter (Dv) to the number average particle diameter (Dn) is 1.00 to 1.30. This enables to obtain the toner with high resolution and high image quality. In addition, in the two-component developer, even when the toner is consumed and supplied over a long time, variation of particle diameters of the toner in the developer is low, as well as in stirring for a long time in a developing apparatus, a good and stable developing property becomes possible. When the Dv/Dn exceeds 1.30, the variation of the particle diameters in individual toner particles becomes large, the variation in toner behavior occurs upon development, reproducibility of fine dots is impaired and the image of high grade is not obtained. More preferably, the Dv/Dn is in the range of 1.00 to 1.20, and the better image is obtained.

In the toner of the present invention, the volume average particle diameter is preferably 3.0 μm to 7.0 μm. Generally it is said that the smaller the particle diameter of the toner is, the more advantageous it is for obtaining the image with high resolution and high quality, but conversely this is disadvantageous for a transfer property and a cleaning property. When the volume average particle diameter is smaller than the above range, in the two-component developer, in the stirring for a long time in the developing apparatus, the toner is fusion-bonded on the surface of a carrier to reduce the electrical charge capacity, and in the one-component developer, filming of the toner onto a developing roller and the fusion-bonding of the toner onto the member such as blade for making the toner thin easily occur. The content of fine powders is largely involved in these phenomena, and in particular when the content of the particles of 2 μm or less exceeds 20%, the toner is adhered to the carrier and it becomes a trouble when safety of the electrical charge is attempted at high level. Conversely, when the particle diameter of the toner is larger than the above range, it becomes difficult to obtain the image with high resolution and high image quality, as well as the variation of the toner particle diameters becomes often large when the toner is consumed and supplied in the developer. Also when the ratio of the volume average particle diameter to the number average particle diameter is larger than 1.30, it was shown that the similar results were also produced.

As described above, the toner having the small particle diameters and uniform particle diameters causes difficulty in cleaning property. Thus, it is preferable that the particles having the circularity of 0.950 or less occupy 20% to 80% of the entire toner particles.

First, a relation between the toner shape and the transfer property will be described. When a full color copying machine transferring by multiple color development is used, compared with the case of the black toner which is one color used in a monochrome copying machine, the amount of the toner on the photoconductor is increased, and it is difficult to enhance the transfer efficiency only using the conventional amorphous toner. Furthermore, when the ordinary amorphous toner is used, due to a scooting force and a frictional force between the photoconductor and the cleaning member, between an intermediate transferring member and the cleaning member and/or between the photoconductor and the intermediate transferring member, the fusion-bonding and the filming of the toner on the photoconductor surface and the intermediate transferring member surface occur to easily deteriorate the transfer efficiency. In generation of the full color image, a four color toner images are hardly transferred uniformly. In addition, when the intermediate transferring member is used, the problem easily occurs in terms of color unevenness and color balance, and it is not easy to stably output the full color image with high quality.

In the light of balance between the blade cleaning and the transfer efficiency, the particles having the circularity of 0.950 or less occupy 20% to 80% of the entire toner particles. This enables to balance between the cleaning and the transfer property. The cleaning and the transfer property are largely associated with the material and an application mode of the blade, and the transfer varies depending on a process condition. Thus, the design depending on the process in the above range becomes possible. However, when the content of the particles having the circularity of 0.950 or less is less than 20% of the entire toner particles, it becomes difficult to perform the cleaning by the blade. When the content of the particles having the circularity of 0.950 or less exceeds 80% of the entire toner particles, the aforementioned transfer property is deteriorated. This phenomenon is caused because the toner excessively alters in shape, thus, the migration of the toner upon transfer (photoconductor surface to transfer paper, photoconductor surface to intermediate transfer belt, first intermediate transfer belt to second intermediate transfer belt) becomes not smooth, and further the variation in behavior between the toner particles occurs, thus, the uniform and high transfer efficiency is not obtained. Additionally, instability of the electrical charge and fragility of the particles begin to express. Furthermore, the phenomenon to make fine powders occurs in the developer, which becomes a factor to reduce durability of the developer.

Methods for measuring the toner shape of the present invention will be shown below.

(Particle Diameter of 2 μm or Less, Circularity)

A rate of particles of 2 μm or less, the circularity and the average circularity of the toner of the present invention can be measured by a flow type particle image analysis apparatus EPIA-2000 (supplied from Toa Medical Electronics Co. Ltd.). In the specific measurement method, 0.1 mL to 0.5 mL of a surfactant as a dispersant, preferably an alkylbenzene sulfonate salt is added to 100 mL to 150 mL of water from which impurities have been previously removed in a vessel, and 0.1 g to 0.5 g of a sample to be measured is further added thereto. A dispersion in which the sample has been dispersed is treated to disperse using an ultrasonic dispersing machine for about 1 to 3 minutes to make a dispersion concentration 3,000 to 10,000/μL, and the shape and the distribution of the toner are measured using the aforementioned apparatus.

(Toner Particle Diameter)

The average particle diameter and the particle size distribution of the toner were measured by Coulter counter method. A measurement apparatus for the particle size distribution of the toner particles includes Coulter Counter TA-II and Coulter Multisizer II (both are supplied from Coulter). In the present invention, the measurement was performed by using Coulter Counter TA-II and connecting an interface (The Institute of Japanese Union of Scientists & Engineers) which outputs the number distribution and the volume distribution, and a PC9801 personal computer (supplied from NEC).

The method for measuring it will be described below.

First, 0.1 mL to 5 mL of the surfactant as the dispersant (preferably alkylbenzene sulfonate salt) is added to 100 mL to 150 mL of an electrolytic aqueous solution. Here, the electrolytic solution is an aqueous solution of about 1% NaCl prepared using 1st grade sodium chloride, and for example, ISOTON-II (supplied from Coulter) can be used. Here, 2 mg to 20 mg of a sample to be measured is added. A dispersion treatment is given to the electrolytic solution in which the sample has been dispersed for about 1 to 3 minutes using an ultrasonic dispersing machine, and the toner particles or the volume, and the number of the toner are measured using 100 μm aperture as the aperture by the aforementioned measurement apparatus to calculate the volume distribution and the number distribution.

As channels, 13 channels of 2.00 μm to less than 2.52 μm, 2.52 μm to less than 3.17 μm, 3.17 μm to less than 4.00 μm, 4.00 μm to less than 5.04 μm, 5.04 μm to less than 6.35 μm, 6.35 μm to less than 8.00 μm, 8.00 μm to less than 10.08 μm, 10.08 μm to less than 12.70 μm, 12.70 μm to less than 16.00 μm, 16.00 μm to less than 20.20 μm, 20.20 μm to less than 25.40 μm, 25.40 μm to less than 32.00 μm and 32.00 μm to less than 40.30 μm are used, and the particles having the particle diameter of 2.00 μm to less than 40.30 μm are subjected. The volume average particle diameter (Dv) based on the volume was calculated from the volume distribution according to the present invention, the number average particle diameter (Dn) was calculated from the number distribution, and their ratio (Dv/Dn) was calculated.

According to the further examination of the present invention, in order to more effectively exert the fixing property at low temperature with keeping a heat resistant storage stability and impart offset resistance after the modification with a prepolymer, it is preferable that the weight average molecular weight of the THF soluble fraction of the acid group-containing polyester resin is 1,000 to 30,000. This is because when it is less than 1,000, an oligomer component is increased and thus the heat resistant storage stability is deteriorated, whereas when it exceeds 30,000, the modification with the prepolymer becomes insufficient due to steric hindrance and thus the offset resistance is deteriorated.

The molecular weight according to the present invention is measured by GPC (gel permeation chromatography) as follows. A column is stabilized in a heat chamber at 40° C., THF as a solvent is run in the column at this temperature at 1 mL/minute, a THF sample solution of the resin prepared at 0.055 by weight to 0.6% by weight as a sample concentration is injected and measured. When the molecular weight was measured, the molecular weight distribution of the sample was calculated from the relation between logarithmic values of a standard curve made from several monodispersion polystyrene standard samples and counted numbers. As the standard polystyrene samples for making the standard curve, for example, those having the molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ supplied from Pressure Chemical Co. or Toyo Soda Kogyo are used, and it is proper to use at least 10 points of the standard polystyrene samples. An RI (refraction index) detector is used for detection.

By making the acid value of polyester resin which is the first binding resin 1.0 (KOH mg/g) to 50.0 (KOH mg/g), it is possible to make the toner properties such as particle diameter control by the addition of the basic compound, fixing property at low temperature, high temperature offset resistance, heat resistant storage stability and electrical charge stability higher grades. That is, when the acid value exceeds 50.0 (KOH mg/g), the extending or crosslinking reaction of the modified polyester becomes insufficient and the high temperature offset resistance is affected. When it is less than 1.0 (KOH mg/g), the dispersion stability effect by the basic compound upon production is not obtained, the extending or crosslinking reaction of the modified polyester easily progresses, and the problem on the production stability occurs.

(Method for Measuring Acid Value)

The measurement is performed under the following condition in accordance with the measurement method described in JIS K0070-1992. Preparation of samples: 0.5 g of polyester is added to 120 mL of THF, and dissolved by stirring at room temperature (23° C.) for about 10 hours. Further 30 mL of ethanol is added to make a sample solution.

The measurement can be calculated using the described apparatus, and specifically calculated as follows.

The sample is titrated using N/10 potassium hydroxide alcohol solution previously determined, and the acid value is obtained by the following calculation from the consumed amount of the potassium hydroxide alcohol solution.

$$\text{Acid value}=\text{KOH (mL)}\times N\times 56.1/\text{sample weight}$$

(N is a factor of N/10 KOH)

Details of the method for measuring the acid value of the polyester of the present invention depends on the following method in accordance with JIS K0070. THF is used as the solvent.

The acid value is specifically determined by the following procedure.

Measurement apparatus: potentiometric automatic titrator DL-53

Titrator (supplied from Mettler Toledo)

Electrode used: DG113-SC (supplied from Mettler Toledo)

Software for analysis: LabX Light Version 1.00.000

Calibration of apparatus: A mixed solvent of 120 mL toluene and 30 mL ethanol is used.

Temperature for measurement: 23° C.

Conditions for measurement are as follows.

| | |
|---|---|
| Stir | |
| Speed [%] | 25 |
| Time [s] | 15 |
| EQP titration | |
| Titrant/Sensor | |
| Titrant | $CH_3ONa$ |
| Concentration [mol/L] | 0.1 |
| Sensor | DG115 |
| Unit of measurement | mV |
| Predispensing | to volume |
| Volume [mL] | 1.0 |
| Wait time [s] | 0 |
| Titrant addition | Dynamic |
| dE(set) [mV] | 8.0 |
| dV(min) [mL] | 0.03 |
| dV(max) [mL] | 0.5 |
| Measure mode | Equilibrium controlled |
| dE [mV] | 0.5 |
| dt [s] | 1.0 |
| t(min) [s] | 2.0 |
| t(max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs | Yes |
| n = | 1 |
| comb. termination conditions | No |
| Evaluation | |
| Procedure | Standard |
| Potential 1 | No |
| Potential 2 | No |
| Stop for reevaluation | No |

In the present invention, the heat resistant storage stability capacity of the major component in the polyester resin after the modification, i.e., the binding resin depends on the glass transition point of the polyester resin before the modification. Thus, it is preferable that the glass transition point of the polyester resin is set at 35° C. to 65° C. That is, when it is less than 35° C., the heat resistant storage stability is insufficient and when it exceeds 65° C., the fixing property at low temperature is adversely affected.

The glass transition point of the present invention is measured using Rigaku THRMOFLEX TG8110 supplied from Rigaku Denki Co., Ltd. under the condition of temperature rising at 10° C./minute.

The method for measuring Tg is reviewed. As the apparatus for measuring Tg, TG-DSC system TAS-100 supplied from Rigaku Denki Co., Ltd. was used.

First, about 10 mg of a sample was placed in a sample vessel made from aluminium, which was then placed on a holder unit and set in an electric furnace. DSC measurement was performed by first heating from the room temperature up to 150° C. at a temperature rising speed of 10° C./minute, leaving stand at 150° C. for 10 minutes, then cooling to the room temperature and leaving stand for 10 minutes, heating again up to 150° C. at a temperature rising speed of 10° C./minute under nitrogen atmosphere. Tg was calculated from a tangent of an endothermic curve in the vicinity of Tg and a contact point with a base line using the analysis system in TAS-100 system.

According to the further examination of the present invention, the prepolymer which modifies the polyester resin is the important binding resin component for realizing the fixing property at low temperature and the high temperature offset resistance, and its weight average molecular weight is preferably 3,000 to 20,000. That is, when the weight average molecular weight is less than 3,000, it becomes difficult to control a reaction speed and the problem on the production stability begins to occur. When the weight average molecular weight is more than 20,000, the sufficient modified polyester is not obtained, and the offset resistance begins to be affected.

According to the further examination of the present invention, it has been found that the acid value of the toner is more important indicator than the acid value of the binding resin for the fixing property at low temperature and the high temperature offset property. The acid value of the toner of the present invention is derived from an end carboxyl group of unmodified polyester. In this unmodified polyester, the acid value is preferably 0.5 (KOH mg/g) to 40.0 (KOH mg/g) for controlling the fixing property at low temperature (fixing lower limit temperature, hot offset occurrence temperature) of the toner. That is, when the acid value of the toner exceeds 40.0 (KOH mg/g), the extending or crosslinking reaction of the modified polyester becomes insufficient and the high temperature offset resistance is affected. When it is less than 0.5 (KOH mg/g), the dispersion stability effect by the basic compound upon production is not obtained, the extending or crosslinking reaction of the modified polyester easily progresses, and the problem on the production stability occurs.

The acid value is specifically determined in accordance with the method for measuring the acid value of the above polyester resin.

When there is a THF insoluble fraction, the above acid value of the toner indicates the acid value when the acid value is measured using THF as the solvent.

(Method for Measuring Acid Value of Toner)

The measurement is performed under the following condition in accordance with the measurement method described in JIS K0070-1992. Preparation of samples: 0.5 g (in ethyl acetate soluble fraction, 0.3 g) of the toner was used in place of the polyester.

The glass transition point of the toner of the present invention is preferably 40° C. to 70° C. for obtaining the fixing property at low temperature, the heat resistant storage stability and the high durability. That is, when the glass transition point is lower than 40° C., blocking in a developing device and filming to the photoconductor easily occur. When it exceeds 70° C., the fixing property at low temperature is easily deteriorated.

The toner of the present invention can be obtained by various methods, e.g., (1) the method in which the toner particles having appropriate sizes as the toner, specifically particle diameters of 3.0 μm to 7.0 μm are made by a granulation step of dispersing a toner raw material mixture containing a binding resin or a monomer which is the raw material thereof, a colorant, a wax component and a charge controlling agent in the water-based medium to produce the particles of the toner raw material mixture, the water-based medium is removed from the produced toner particles and the toner particles are washed and dried to yield the toner; (2) the method in which the resin is made by emulsification polymerization and hetero-aggregated with a pigment and a releasing agent and then an emulsification polymerization aggregation fusion method of fusing and integrating is performed to yield the toner; and (3) a dissolution or a dispersion formed by dissolving or dispersing a toner composition composed of a colorant and a binder component composed of at least a modified polyester resin (toner composition precursor) capable of reacting active hydrogen in an organic solvent is reacted with a crosslinking agent and/or an extending agent in the water-based medium containing a dispersant, and the solvent is removed from the resulting dispersion to yield the toner. In this method, the toner is obtained by dissolving or dispersing a toner composition composed of a binder component composed of at least a modified polyester based resin capable of reacting with active hydrogen, and the colorant in the organic solvent, reacting the resulting solution or dispersion with a crosslinking agent or an extending agent in a hydrogen medium containing the dispersant, and removing the solvent from the resulting dispersion.

A reactive modified polyester based resin (RMPE) capable of reacting with active hydrogen used in the present invention includes, for example, polyester prepolymers (A) having isocyanate group. This prepolymer (A) includes those which are polycondensates of polyol (PO) and carboxylic acid (PC) and in which polyester having active hydrogen is further reacted with polyisocyanate (PIC). The group comprising active hydrogen which the above polyester has includes hydroxyl groups (alcoholic hydrogen group and phenolic hydroxyl group), amino groups, carboxyl groups and mercapto groups. Among them, the alcoholic hydroxyl group is preferable.

As the crosslinking agent for the reactive modified polyester based resin, amines are used, and as the extending agent, diisocyanate compounds (diphenylmethane diisocyanate) are used. Amines described later in detail act as the crosslinking agent and the extending agent for the modified polyester based resin capable of reacting with active hydrogen.

The modified polyester such as urea-modified polyester obtained by reacting amines (B) with the polyester prepolymer (A) having the isocyanate group is convenient for assuring the dry toner, particularly oilless fixing property at low temperature (broad releasing property and fixing property having no releasing oil application mechanism for heating medium for fixing) because the molecular weight of its macromolecular component is easily controlled. In particular, in the polyester prepolymer having the end modified with urea, adhesiveness to the heating medium for fixing can be suppressed with keeping high fluidity in fixing temperature range and transparency of the unmodified polyester resin itself.

The preferable polyester prepolymer used in the present invention is obtained by introducing the functional group such as isocyanate group reacting with the active hydrogen into polyester having the active hydrogen group such as acid group and hydroxyl group at the end. The modified polyester (MPE) such as urea-modified polyester can be induced from this prepolymer. In the case of the present invention, the preferable modified polyester used as the binding resin is the urea-modified polyester obtained by reacting amines (B) as the crosslinking agent and/or extending agent with the polyester prepolymer (A) having the isocyanate group. The polyester prepolymer (A) having the isocyanate group can be obtained by further reacting polyester which is the polycondensate of polyol (PO) and polycarboxylic acid (PC) and having the active hydrogen with polyisocyanate (PIC). The active hydrogen group which the above polyester has includes hydroxyl groups (alcoholic hydroxyl group and phenolic hydroxyl group), amino groups, carboxyl groups and mercapto groups. Among them, the alcoholic hydroxyl group is preferable.

Polyol (PO) includes diol (DIO) and trivalent or more polyol (TO). DIO alone or a mixture of DIO and TO in a small amount is preferable. Diol (DIO) includes alkylene glycol (ethylene glycol, 1,2-propylene glycol, 1,3-propylene glycol, 1,4-butanediol, 1,6-hexanediol); alkylene ether glycol (diethylene glycol, triethylene glycol, dipropylene glycol, polyethylene glycol, polypropylene glycol, polytetramethylene ether glycol); alicyclic diol (1,4-cyclohexane dimethanol, hydrogenated bisphenol A); bisphenols (bisphenol A, bisphenol F, bisphenol S); alkylene oxide (ethylene oxide, propylene oxide, butylene oxide) adducts of the above alicyclic diol; and alkylene oxide (ethylene oxide, propylene oxide, butylene oxide) adducts of the above bisphenols. Among them, alkylene glycol having 2 to 12 carbon atoms and alkylene oxide adducts of bisphenols are preferable, and the most preferable are alkylene oxide adducts of bisphenols and combination of alkylene glycol having 2 to 12 carbon atoms therewith. Trivalent or more polyol (TO) includes trivalent to octavalent or more polyvalent aliphatic alcohol (glycerine, trimethylol ethane, trimethylol propane, pentaerythritol, sorbitol); trivalent or more phenols (trisphenol PA, phenol novolac, cresol novolac) and alkylene oxide adducts of the above trivalent or more polyphenols.

Polycarboxylic acid (PC) includes dicarboxylic acid (DIC) and trivalent or more polycarboxylic acids (TC). DIC alone or a mixture of DIC and TC in a small amount is preferable. Dicarboxylic acid (DIC) includes alkylene dicarboxylic acids (succinic acid, adipic acid, sebacic acid); alkenylene dicarboxylic acids (maleic acid, fumaric acid); and aromatic dicarboxylic acids (phthalic acid, isophthalic acid, terephthalic acid, naphthalene dicarboxylic acid). Among them, preferable are alkenylene dicarboxylic acids having 4 to 20 carbon atoms and aromatic dicarboxylic acids having 4 to 20 carbon atoms. Trivalent or more polycarboxylic acids include polycarboxylic acids having 9 to 20 carbon atoms (trimellitic acid, pyromellitic acid). As polycarboxylic acid, acid anhydride or lower alkyl ester of the above may be used and reacted with polyol (PO). As the ratio of polyol (PO) to polycarboxylic acid (PC), the ratio of hydroxyl group [OH] to carboxyl group [COOH] ([OH]/[COOH]) is typically 2/1 to 1/1, preferably 1.5/1 to 1/1 and more preferably 1.3/1 to 1.02/1.

Polyisocyanate (PIC) includes aliphatic polyisocyanate (tetramethylene diisocyanate, hexamethylene diisocyanate, 2,6-diisocyanatmethylcaproate); alicyclic polyisocyanate (isoboron diisocyanate, cyclohexylmethane diisocyanate); aromatic diisocyanate (trilene diisocyanate, diphenylmethane diisocyanate); aromatic aliphatic diisocyanate ($\alpha,\alpha,\alpha',\alpha'$-tetramethylxylylene diisocyanate); isocyanurates; those obtained by blocking the above polyisocyanate with phenol derivative, oxime or caprolactam; and combinations thereof (two or more).

As the ratio of polyisocyanate (PIC), an equivalent ratio of isocyanate group [NCO] to hydroxyl group [OH] of polyester having the hydroxyl group [NCO]/[OH] is typically 5/1 to 1/1, preferably 4/1 to 1.2/1 and more preferably 2.5/1 to 1.5/1. When [NCO]/[OH] is more than 5, the fixing property at low temperature is deteriorated. If a molar ratio of [NCO] is less than 1, when the modified polyester is used, the content of urea in the ester becomes low and the hot offset resistance is deteriorated. The content of polyisocyanate (3) component in the prepolymer (A) having the isocyanate group at the end is typically 0.5% by weight to 40% by weight, preferably 1% by weight to 30% by weight and more preferably 2% by weight to 20% by weight. When it is less than 0.5% by weight, the hot offset resistance is deteriorated as well as it is disadvantageous in terms of both heat resistant storage stability and fixing property at low temperature. When it exceeds 40% by weight, the fixing property at low temperature is deteriorated.

The number of the isocyanate group contained per one molecule of the prepolymer (A) having the isocyanate group is typically one or more, preferably 1.5 to 3 in average and more preferably 1.8 to 2.5 in average. When it is less than one per molecule, the molecular weight of the urea-modified polyester becomes low, and the hot offset resistance is deteriorated.

Amines include diamine (B1), trivalent or more polyamines (B2), amino alcohol (B3), aminomercaptan (B4) amino acids (B5) and those (B6) obtained by blocking the amino group of B1 to B5. Diamine (B1) includes aromatic diamines (phenylenediamine, diethyltoluenediamine, 4,4'-diaminodiphenylmethane); alicyclic diamines (4,4'-diamino-3,3'-dimethyldicyclohexylmethane, diaminecyclohexane, isohorondiamine); and aliphatic diamines (ethylenediamine, tetramethylenediamine, hexamethylenediamine). Trivalent or more polyamines (B2) include diethylenetriamine and triethylenetetraamine. Amino alcohol (B3) includes ethanolamine and hydroxyethylaniline. Aminomercaptan (B4) includes aminoethylmercaptan and aminopropylmercaptan. Amino acids (B5) include amino propionic acid and amino caproic acid. Those (B6) obtained by blocking the amino group of B1 to B5 include ketimine compounds and oxazolidine compounds obtained from amines of the above B1 to B5 and ketones (acetone, methyl ethyl ketone, methyl isobutyl ketone). Among these amines (B), preferable are B1 and the mixture of B1 and B2 in a small amount.

In addition, by using an extension terminator if necessary, it is possible to adjust the molecular weight of polyester. The extension terminator includes monoamine (diethylamine, dibutylamine, butylamine, laurylamine) and those (ketimine compounds) obtained by blocking them.

As the ratio of amines (B), the equivalent ratio of isocyanate group [NCO] in the prepolymer (A) having the isocyanate group to amino group [NHx] in amines (B) [NCO]/[NHx] is typically 1/2 to 2/1, preferably 1.5/1 to 1/1.5 and more preferably 1.2/1 to 1/1.2. When [NCO]/[NHx] exceeds 2 or is less than 1/2, the molecular weight of polyester becomes low and the hot offset resistance is deteriorated.

In the present invention, the polyester based resin (polyester) preferably used as the binding resin is the urea-modified polyester (UMPE), and an urethane bond may be contained together with an urea bond in this polyester. The molar ratio of an urea bond content to an urethane bond content is typically 100/0 to 10/90, preferably 80/20 to 20/80 and more preferably 60/40 to 30/70. When the molar ratio of the urea bond content is less than 10%, the hot offset resistance is deteriorated.

The modified polyester such as urea-modified polyester (UMPE) is produced by one shot method. The weight average molecular weight of the modified polyester such as urea-modified polyester(UMPE) is typically 10,000 or more, preferably 20,000 to 10,000,000, and more preferably 30,000 to 1,000,000. When it is less than 10,000, the hot offset resistance is deteriorated. The number average molecular weight of the modified polyester such as urea-modified polyester is not particularly limited when unmodified polyester described later is used, and could be the number average molecular weight at which the aforementioned weight average molecular weight is easily obtained. In the case of the urea-modified polyester(UMPE) alone, its number average molecular weight is typically 2,000 to 15,000, preferably 2,000 to 10,000 and more preferably 2,000 to 8,000. When it exceeds 15,000, the fixing property at low temperature and glossiness when used for a full color apparatus are deteriorated.

In the present invention, not only the modified polyester such as polyester(UMPE) modified with urea is used alone but also together with this, unmodified polyester (PE) can be contained as the binding resin. By combining PE, the fixing property at low temperature and the glossiness when used for the full color apparatus are enhanced, and this is more preferable than the case of using alone. PE includes the polycondensate of polyol (PO) and polycarboxylic acid (PC) which are the same as the polyester components in the above UMPE, and preferable are the same as in the case of UMPE. The weight average molecular weight (Mw) of PE is 10,000 to 300,000 and preferably 14,000 to 200,000. Its Mn (number average molecular weight) is 1,000 to 10,000 and preferably 1,500 to 6,000. Not only unmodified polyester but also polyester modified with a chemical bond other than the urea bond, e.g., polyester modified with the urethane bond can be combined with UMPE. It is preferable in terms of fixing property at low temperature and hot offset resistance that UMPE and PE are at least partially compatible. Therefore, it is preferable that the polyester component of UMPE and PE have similar compositions. In the case of containing PE, a weight ratio of UMPE to PE is typically 5/95 to 80/20, preferably 5/95 to 30/70 and more preferably 5/95 to 25/75. Particularly preferable is 7/93 to 20/80. When the weight ratio of UMPE is less than 5%, the hot offset resistance is deteriorated, as well as it is disadvantageous in terms of both heat resistant storage stability and fixing property at low temperature.

A hydroxyl value (mg KOH/g) of PE is preferably 5 or more, and the acid value (mg KOH/g) of PE is typically 1 to 30 and preferably 5 to 20. By making PE carry the acid value, PE is easily charged negatively, further affinity of paper with the toner is good upon fixing to the paper, and the fixing property at low temperature is enhanced. However, when the acid value exceeds 30, the stability of electrical charge tends to deteriorate for environmental variation. In the polymerization reaction, the variance of the acid value leads to the variation in a granulation step, and it becomes difficult to control the emulsification.

(Method for Measuring Hydroxyl Value)

The condition of the measurement apparatus is the same as in the measurement of the acid value described above.

A sample (0.5) is precisely weighed and taken in a 100 mL measuring flask, and 5 mL of an acetylation reagent is correctly added thereto. Subsequently, the flask is immersed in a water bath at 100° C.±5° C., and heated. After one to two hours, the flask is removed from the water bath. After cooling, water is added and stirred to decompose acetic acid anhydride. In order to more completely decompose, the flask is heated again in the water bath for 10 minutes or more, and after cooling, the flask wall is thoroughly washed with the organic solvent. The potentiometric titration is performed in this solution using the aforementioned electrode with N/2 potassium hydroxide ethyl alcohol solution to obtain an OH value (in accordance with JIS K0070-1966).

In the present invention, the glass transition point (Tg) of the binding resin is typically 40° C. to 70° C. and preferably 40° C. to 60° C. When it is less than 40° C., the heat resistance of the toner is deteriorated. When it exceeds 70° C., the fixing property at low temperature becomes insufficient. In the dry toner of the present invention, even when the glass transition point is lower than that in the polyester based toner known publicly, the heat resistant storage stability tends to be good by coexistence of the modified polyester such as urea-modified polyester.

(Releasing Agent)

As the releasing agent (wax) used in the toner of the present invention, the wax having a low melting point of 50° C. to 120° C. works between a fixing roller and a toner interface more effectively as the releasing agent in the dispersion with the binding resin, thereby exhibiting the effect on the high temperature offset resistance without applying the releasing agent such as oils on the fixing roller.

The melting point of the wax in the present invention was a maximum endothermic peak by a differential scanning calorimeter (DSC).

As wax components which function as the releasing agent usable in the present invention, the following materials can be used. That is, specific examples as brazing filler metals and waxes include plant waxes such as carnauba wax, cotton wax, wood wax and rice wax; animal waxes such as bee wax and lanolin; mineral waxes such as ozokerite and selsyn; and petroleum waxes such as paraffin, microcrystalline and petrolatum. In addition to these natural waxes, synthetic hydrocarbon waxes such as Fischer-Tropsch wax and polyethylene wax, and synthetic waxes of ester, ketone and ether are also included. In addition, fatty acid amides such as 12-hydroxystearic acid amide, stearic acid amide, imide phthalate anhydride and chlorinated hydrocarbon, and crystalline polymers having long alkyl group in the side chain such as homopolymers or copolymer (e.g., copolymer of n-stearyl acrylate-ethyl methacrylate) of polyacrylate such as poly n-stearyl methacrylate and poly n-lauryl methacrylate which are crystalline polymer resins having the low molecular weight can also be used.

(Colorant)

As the colorant used in the present invention, all dyes and pigments publicly known can be used. For example, carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, lithopone and mixtures thereof can be used. The content of the colorant is typically 1% by weight to 15% by weight and preferably 3% by weight to 10% by weight relative to the toner.

The colorant used in the present invention can be used as a master batch in which the colorant has made a complex with the resin, The binding resin used for the production of the master batch or kneaded with the master batch includes, in addition to modified and unmodified polyester resins described above, polymers of styrene such as polystyrene, poly p-chlorostyrene and polyvinyl toluene and substituents thereof; styrene based copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleate ester copolymers; polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin and paraffin wax, which can be used alone or in mixture.

The present master batch can be obtained by mixing and kneading the resin for the master batch and the colorant with a high shearing force. At that time, the organic solvent can be used to enhance the interaction of the colorant and the resin. The method referred to as so-called flashing method in which a water-based paste of the colorant comprising water is mixed and kneaded with the resin and the organic solvent, the colorant is transferred to the resin side and the water and the organic solvent components are removed is preferably used because a wet cake of the colorant can be directly used and thus it is not necessary to dry. To mix and knead, a high shearing dispersion apparatus such as three roll mill is preferably used.

In order to adhere and immobilize the charge controlling agent on the toner particle surface, the method for producing the toner for electrographs, in which the particles comprising the colorant and the resin and the particles composed of at least charge controlling agent particles are mixed one another in a vessel using a rotation body has been known. In the present invention, in this method, by comprising the step of mixing at a peripheral velocity of 40 m to 150 m/second of the rotation body in a vessel having no fixing member protruded from an inner wall of the vessel, the objective toner particles can be obtained.

The toner of the present invention may contain the charge controlling agent if necessary. The charge controlling agents known publicly can be used, and include, for example, nigrosine dyes, triphenylmethane dyes, chromium-containing metal complex dyes, molybdic acid chelate pigments, rhodamine-based dyes, alkoxy-based amine, quaternary ammonium salts (including fluorine modified quaternary ammonium salts), alkylamide, a single body or compounds of phosphorus, a single body or compounds of tungsten, fluorine-based active agents, salicylate metal salts and metal salts of salicylic acid derivatives. Specifically, Bontron 03 of the nigrosine dye, Bontron P-51 of the quaternary ammonium salt, Bontron S-34 of the metal-containing azo dye, E-82 of oxynaphthoic acid-based metal complex, E-81 of salicylic acid-based metal complexes, E-89 of phenol-based condensate (supplied from Orient Chemical Industries Ltd.); TP-302 and TP-415 of a quaternary ammonium salt molybdenum complexes (supplied from Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (supplied from Hoechst); LRA-901, LA-147 which is a boron complex (supplied from Japan Carlit Co., Ltd.) copper phthalocyanine, perylene, quinacridone, azo-based pigments, and polymer-based compounds having functional groups such as sulfonic acid group, carboxyl group and quaternary ammonium salt are included.

In the present invention, the amount of the charge controlling agent to be used is determined depending on the type of the binding resin, the presence or absence of the additive if necessary and the methods for producing the toner including the dispersion method, and is not primarily limited, but is used in the range of 0.1 parts by weight to 10 parts by weight relative to 100 parts by weight of the binder resin. The range of 0.2 parts by weight to 5 parts by weight is preferable. When it exceeds 10 parts by weight, the electrical charge property of the toner is too large, the effect of the major charge controlling agent is reduced, and electrostatic sucking force with the developing roller is increased, leading to the reduction of fluidity of the developer and the reduction of the image density. These charge controlling agent and the releasing agent can also be melted and kneaded with the master batch and the resin, and of course may be added into the organic solvent upon dissolving or dispersing.

An externally added agent is used in order to aid the fluidity, the developing property and the charge property of the colored particles obtained in the present invention. As the externally added agent, inorganic particles can be preferably used. A primary particle diameter of this inorganic particle is preferably 5 μm to 2 μm and in particular preferably 5 μm to 500 μm. Its specific surface area by BET method is 20 $m^2/g$ to 500 $m^2/g$. The amount of these inorganic particles to be used is preferably 0.01% by weight to 5% by weight and in particular preferably 0.01% by weight to 2.0% by weight relative to the toner. Specific examples of the inorganic particles can include, for example, silica, alumina, titanium oxide, barium titanate, magnesium titanate, calcium titanate, strontium titanate, zinc oxide, tin oxide, quartz sand, clay, mica, sand-lime stone, diatom earth, chromium oxide, cerium oxide, colcothar, antimony trioxide, magnesium oxide, zirconium oxide, barium sulfate, barium carbonate, calcium carbonate, silicon carbide, and silicon nitride. Among them, as a fluidity imparting agent, it is preferable to combine hydrophobic silica fine particles with hydrophobic titanium oxide fine particles. In particular, when those in which the average particle diameter of both particles is 50 μm or less are used and stirred/mixed, an electrostatic force and Van der Waals' forces with the toner are dramatically enhanced. Thus, it has been found that even by stirring/mixing inside the developing device performed to obtain the desired charge level, the good image quality on which no firefly occurs is obtained without releasing the fluidity imparting agent from the toner and the remaining toner after the transfer is reduced.

The titanium oxide fine particle is excellent in environmental stability and image density stability, but tends to deteriorate a charge initial rise property. Thus, when the amount of the titanium oxide fine particles to be added is larger than the amount of the silica fine particles to be added, it is thought that its side effect becomes large. However, it has been found that when the amount of the silica fine particles and the titanium oxide fine particles to be added is in the range of 0.3% by weight to 5% by weight, the charge initial rise property is not largely impaired, the desired charge initial rise property is obtained, i.e., even if the copying is repeated, the stable image quality is obtained and toner blow can also be inhibited.

The binding resin can be produced by the following method. Polyol (PO) and polycarboxylic acid (PC) are heated at 150° C. to 280° C. in the presence of a publicly known esterification catalyst such as tetrabutoxy titanate or dibutyltin oxide with reducing pressure and distilling off generated water if necessary to yield polyester having hydroxyl group. Then, at 40° C. to 140° C., polyisocyanate (PIC) is reacted with this to yield polyester prepolymer (A) having isocyanate group. Further, at 0° C. to 140° C., amines (B) are reacted with this (A) to yield polyester (UMPE) modified with an urea bond. The number average molecular weight of this modified polyester is 1,000 to 10,000 and preferably 1,500 to 6,000. When reacting PIC and when reacting A with B, the solvent can also be used if necessary. The usable solvents include aromatic solvents (toluene, xylene), ketones (acetone, methyl ethyl ketone, methyl isobutyl ketone), esters (ethyl acetate), amides (dimethylformamide, dimethylacetamide), and ethers (tetrahydrofuran), which are inert for isocyanate (PIC). When polyester (PE) which is not modified with the urea bond is combined, PE is produced in the same way as in the case of polyester having the hydroxyl group and this is dissolved and mixed in the solution after completing the reaction of the UMPE.

The toner of the present invention can be produced by the following method, but of course the method is not limited thereto.

(Suspension Polymerization Production Method)

In the suspension polymerization method, the toner is obtained by dispersing and/or emulsifying the monomer phase comprising at least the toner composition and /or the toner composition precursor in the water-based medium to granulate.

In this method, the toner particles having appropriate sizes as the toner, specifically particle diameters of 3 μm to 12 μm are made by a granulation step of dispersing the toner raw material mixture containing the binding resin or the monomer which is the raw material thereof, the layered inorganic material in which at least a part has been exchanged with the organic ion, the colorant, the wax component and the charge controlling agent in the water-based medium to produce the particles of the toner raw material mixture, the water-based medium is removed from the produced toner particles and the toner particles are washed and dried to yield the toner.

In the method in which the toner particles are directly obtained by the suspension polymerization method, as the monomer which can be used for forming the binding resin, specifically, styrene; styrene derivatives such as o- (m-, p-)methylstyrene and m-(p-)ethylstyrene; (meth)acrylate ester based monomers such as methyl (meth)acrylate, ethyl (meth)acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth)acrylate, dimethylaminoethyl (meth)acrylate and diethylaminoethyl (meth)acrylate; ene based monomers such as butadiene, isoprene, cyclohexene, (meth)acrylonitrile and acrylic acid amide are preferably used. These are used alone or by appropriately mixing the monomers to exhibit a theoretical glass transition temperature (Tg) at 40° C. to 75° C. as generally described in a publication, Polymer Handbook 2nd edition III, pages 139 to 192 (John Wiley & Son). When the glass transition temperature is lower than 40° C. problems easily occur in terms of storage stability and durability stability of the toner. When it exceeds 75° C., a fixing point of the toner is increased and the fixing property and color reproducibility are deteriorated. Furthermore, in the present invention, it is preferable to use the crosslinking agent upon synthesis of the binding resin in order to increase the mechanical strength and the color reproducibility of the toner.

The crosslinking agent used for the toner according to the present invention includes divinyl benzene, bis(4-acryloxy-polyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol "200, #400 #600 diacrylate, dipropylene glycol diacrylate, polyester type diacrylate (MANDA, Nippon Kayaku Co., Ltd.), and those in which the above acrylate has been changed to methacrylate) as difunctional crosslinking agents. Polyfunctional crosslinking agents include pentaerythritol triacrylate, trimethylolethane triacrylate, trimethylolpropane triacrylate, tetramethylolmethane tetraacrylate, oligoester acrylate and methacrylate thereof, 2,2-bis(4-methacryloxy, polyethoxyphenyl)propane, diallyl phthalate, triallyl cyanurate, triallyl isocyanurate and trially trimeritate.

(Emulsification Polymerization Aggregation Method)

In the emulsification polymerization aggregation method, the toner is obtained by dispersing and/or emulsifying the oil phase or a monomer phase comprising at least the toner composition or the toner composition precursor in the water-based medium to granulate.

The toner for the electrostatic charge image development of the present invention can easily exert the effects of the present invention when produced by the emulsification polymerization aggregation method in which the resin is made by the emulsification polymerization, is hetero-aggregated together with the dispersion of the layered inorganic material in which at least a part has been exchanged with the organic ion, the pigment and the releasing agent, and then the toner is produced by the emulsification polymerization aggregation method of fusing and integrating.

The emulsification polymerization aggregation method comprises a preparation step (hereinafter sometimes referred to as a "aggregation step") of an aggregated particle dispersion, in which a resin particle dispersion prepared by the emulsification polymerization, a separately prepared dispersion of the layered inorganic material in which at least a part has been exchanged with the organic ion and the colorant, and if necessary a dispersion of the releasing agent are mixed, and at least the resin particles, the layered inorganic material in which at least a part has been exchanged with the organic ion and the colorant are aggregated to form aggregated particles; and a step (hereinafter referred to as a "fusion step") of forming the toner particles by heating and fusing the aggregated particles.

In the aggregation step, the resin particle dispersion, the layered inorganic material in which at least a part has been exchanged with the organic ion, the colorant dispersion and if necessary the releasing agent dispersion are mutually mixed and the resin particles are aggregated to form the aggregated particles. The aggregated particles are formed by hetero-aggregation, and at that time, it is possible to add compounds having monovalent or more charge, such as metals and ionic surfactants having different polarity from the aggregated particles for the purpose of stabilization, and control of particle diameters/particle size distribution of the aggregated particles. In the fusion step, the fusion is performed by heating to the temperature equal to or higher than the glass transition temperature of the resin in the aggregated particles.

Before the fusion step, an adhesion step can be provided in which adhesion particles are formed by adding and mixing the other fine particle dispersion to the aggregated particle dispersion and evenly adhering the fine particles to the surface of the aggregated particles. Further another adhesion step can be provided in which the adhesion particles are formed by adding and mixing the layered inorganic material in which at least a part has been exchanged with the organic ion to the aggregated particle dispersion and evenly adhering the layered inorganic material in which at least a part has been exchanged with the organic ion on the surface of the aggregated particles. In order to firm the adhesion of the layered inorganic material in which at least a part has been exchanged with the organic ion, another adhesion step can be provided in which the adhesion particles are formed by adding and mixing the other fine particle dispersion and evenly adhering the fine particles on the surface of the aggregated particles after adhering the layered inorganic material in which at least a part has been exchanged with the organic ion. This adhesion particles are fused by heating to the temperature equal to or higher than the glass transition temperature of the resin as is the case with the above to form the fusion particles.

The fusion particles fused in the fusion step are present as the colored fusion particle dispersion in the water-based medium. The fusion particles are removed from the water-based medium in a washing step as well as contaminated impurities are eliminated in the steps. Then, the fusion particles are dried to yield the toner for the electrostatic charge development as powders.

In the washing step, acidic water, or basic water in some cases in several times relative to the fusion particles is added and stirred, which is then filtrated to yield a solid content. Purified water several times relative to the solid content is added thereto, which is then filtrated. This process is repeated several times until pH of a filtrate after the filtration becomes about 7 to yield colored toner particles. In the drying step, the toner particles obtained in the washing step are dried at the temperature lower than the glass transition temperature. At that time, if necessary, drying air is circulated or the heating is performed under vacuum.

In the present invention, in order to stabilize the dispersibility of the resin particle dispersion, the colorant dispersion and the releasing agent dispersion, the alicyclic compound of the organic metal salt which is the emulsifier of the present invention can be directly used. However, when due to pH dependent stability of the colorant dispersion and the releasing agent dispersion, the dispersibility is not always stable under a basic condition, the surfactant in some amount can be used because of stability with time of the resin particle dispersion.

The surfactant includes, for example, anionic surfactants such as sulfate ester salt based, sulfonate salt based, phosphate ester based and soap based surfactants; cationic surfactants such as amine salt type and quaternary ammonium salt type surfactants; nonionic surfactants such as polyethylene glycol based, alkylphenolethylene oxide adduct based and polyvalent alcohol based surfactants. Among them, the ionic surfactant is preferable, and the anionic surfactant and the cationic surfactant are more preferable. In the toner of the present invention, the anionic surfactant has a strong dispersion force and excellent in dispersibility of the resin particles and the colorant, and the cationic surfactant is advantageous as the surfactant to disperse the releasing agent. The nonionic surfactant is preferably combined with the anionic surfactant or the cationic surfactant. The surfactants may be used alone or in combination of two or more.

Specific examples of the anionic surfactant include fatty acid soaps such as potassium laurate, sodium oleate and sodium castor oil; sulfate esters such as octyl sulfate, lauryl sulfate and nonylphenyl ether sulfate; sodium alkyl naphthalene sulfonate such as lauryl sulfonate, dodecylbenzene sulfonate, triisopropylnaphthalene sulfonate, dibutylnaphthalene sulfonate; sulfonate salts such as naphthalene sulfonate formalin condensate, monooctyl sulfosuccinate, dioctyl sulfosuccinate, laurate amide sulfonate and oleate amide sulfonate; phosphate esters such as lauryl phosphate, isopropyl phosphate and nonylphenyl ether phosphate; dialkyl sulfosuccinate salts such as sodium dioctyl sulfosuccinate; and sulfosuccinate salts such as lauryl disodium sulfosuccinate.

Specific examples of the cationic surfactant include amine salts such as lauryl amine hydrochloride salts, stearyl amine hydrochloride salts, oleyl amine acetate salts, stearyl amine acetate salts and stearylaminopropylamine acetate salts; quaternary ammonium salts such as lauryltrimethyl ammonium chloride, dilauryldimethyl ammonium chloride, distearyl ammonium chloride, distearylaimethyl ammonium chloride, lauryldihydroxydiethylmethyl ammonium chloride, oleylbispolyoxyethylenemethyl ammonium chloride, lauroylaminopropyldimethylethyl ammonium ethosulfate, lauroylaminopropyldimethylhydroxyethyl ammonium perchlorate, alkyl benzenedimethyl ammonium chloride and alkyl trimethyl ammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octylphenyl ether and polyoxyethylene nonylphenyl ether; alkyl esters such as polyoxyethylene laurate, polyoxyethylene stearate and polyoxyethylene oleate; alkyl amines such as polyoxyethylene laurylamino ether, polyoxyethylene stearylamino ether, polyoxyethylene oleylamino ether, polyoxyethylene soy bean amino ether and polyoxyethylene beef tallow amino ether; alkyl amides such as polyoxyethylene laurate amide, polyoxyethylene stearate amide and polyoxyethylene oleate amide; plant oil ethers such as polyoxyethylene castor oil ether and polyoxyethylene rape oil ether; alkanol amides such as laurate diethanol amide, stearate diethanol amide and oleate diethanol amide; sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each dispersion could be an extent that does not inhibit the characteristics of the present invention, is generally a small amount, is about 0.01% by weight to 1% by weight, preferably 0.02% by weight to 0.5% by weight and more preferably 0.1% by weight to 0.2% by weight. When the content is less than 0.01% by weight, the aggregation sometimes occurs particularly in the state in which pH of the resin particle dispersion is not sufficiently basic. In the case of the colorant dispersion and the releasing agent dispersion, its content is 0.01% by weight to 10% by weight, preferably 0.1% by weight to 5% by weight and more preferably 0.5% by weight to 0.2% by weight. When the content is less than 0.01% by weight, particular particles are liberated because the stability upon aggregation is different among particles. When it exceeds 10% by weight, the particle size distribution of the particles becomes broad and the control of the particle diameter becomes difficult, which are not preferable.

In the toner of the present invention, it is possible to add other fine particles such as internally adding agents, charge controlling agents, inorganic particles, organic particles, lubricants and polishing agents in addition to the resin, the colorant and the releasing agent.

The internally adding agent is used at an extent which does not inhibit the charge property as the toner property, and includes, for example, metals and alloys of ferrite, magnetite, reduced iron, cobalt, manganese and nickel, and magnetic materials such as compounds containing these metals.

The charge controlling agent is not particularly limited, and in the color toner, those which are colorless or thinly colored are preferably used. For example, quaternary ammonium salt compounds, nigrosine based compounds, dyes composed of a complex with aluminium, iron or chromium and triphenylmethane based pigments are used.

The inorganic particles include, for example, all particles of silica, titania, calcium carbonate, magnesium carbonate, tricalcium carbonate and cerium oxide typically used as an externally adding agent for the toner surface. The organic particles include for example, all particles of vinyl based resins, polyester resins and silicone resins typically used as an externally adding agent for the toner surface. These inorganic particles and organic particles can be used as a fluidity aid and a cleaning aid. The lubricant includes, for example, fatty acid amide such as ethylene bis-stearate amide and oleate amide, and fatty acid metal salts such as calcium stearate. The polishing agent includes, for example, aforementioned silica, alumina and cerium oxide.

When the resin particle dispersion, the dispersion of the layered inorganic material in which at least a part has been exchanged with the organic ion, the colorant dispersion and the releasing agent dispersion are mixed as described above, the content of the colorant could be 50% by weight or less and is preferably in the range of 2% by weight to 40% by weight. The content of the layered inorganic material in which at least a part has been exchanged with the organic ion is preferably in the range of 0.05% by weight to 10% by weight. The content of the other component could be the extent which does not inhibit the object of the present invention, is generally an extremely small amount, and specifically n the range of 0.01% by weight to 5% by weight and preferably n the range of 0.5% by weight to 2% by weight.

In the present invention, the water-based medium is used as the dispersion medium of the resin particle dispersion, the dispersion of the layered inorganic material in which at least a part has been exchanged with the organic ion, the colorant dispersion, the releasing agent dispersion and the dispersion of the other component. Specific examples of the water-based medium include, for example, water such as distilled water and ion exchange water, and alcohol. These may be used alone or in combination of two or more.

In the step of preparing the aggregated particle dispersion of the present invention, the aggregated particles can be prepared by adjusting an emulsifying force of the emulsifier with pH to produce the aggregation. Simultaneously, an aggregating agent may be added for the method to obtain the aggregated particles stably and rapidly and obtain the aggregated particles having the narrower particle size distribution. The aggregating agent is preferably a compound having the monovalent or more charge, and specifically includes water soluble surfactants such as nonionic surfactants; acids such as hydrochloric acid, sulfuric acid, nitric acid, acetic acid and oxalic acid; metal salts of inorganic acids such as magnesium chloride, sodium chloride, aluminium sulfate, calcium sulfate, ammonium sulfate, aluminium nitrate, silver nitrate, copper sulfate and sodium carbonate; metal salts of fatty acids or aromatic acids such as sodium acetate, potassium formate, sodium oxalate, sodium phthalate and potassium salicylate; metal salts of phenol such as sodium phenolate; metal salts of amino acids; inorganic acid salts of fatty acids or aromatic amines such as triethanolamine hydrochloride salts and aniline hydrochloride salts. Considering the stability of the aggregated particles, stability to heat and with time of the aggregating agent and elimination upon washing, the metal salt of the inorganic acid is preferable in terms of performance and use.

The amount of these aggregating agents to be added varies depending on the valence of the charge, is always a small amount, and is about 3% by weight or less in the case of the monovalent charge, about 1% by weight or less in the case of the bivalent charge, about 0.5% by weight or less in the case of the trivalent charge. The smaller amount of the aggregating agent to be added is more preferable, and the compound having the higher valence is more suitable because the amount to be added can be reduced.

The method for dispersion is not particularly limited, and publicly known equipments such as a low speed shearing mode, a high speed shearing mode, a friction mode, a high pressure jet mode and an ultrasonic mode can be applied. The high speed shearing mode is preferable for making the particle diameters of the dispersion 2 μm to 20 μm. When a high speed shearing mode dispersing machine is used, a rotation frequency is not particularly limited, is typically 1,000 rpm to 30,000 rpm and preferably 5,000 rpm to 20,000 rpm. A dispersion time is not particularly limited, and in the case of a batch system, is typically 0.1 minutes to 5 minutes. The temperature upon dispersion is typically 0° C. to 150° C. (pressurized) and preferably 40° C. to 98° C. The higher temperature is preferable because the viscosity of the dispersion composed of urea-modified polyester and the prepolymer (A) is low and the dispersing is easy.

The amount of the water-based medium to be used is typically 50 parts by weight to 2,000 parts by weight and preferably 100 parts by weight to 1,000 parts by weight relative to 100 parts by weight of the toner composition component comprising polyester such as urea-modified polyester and prepolymer (A). When it is less than 50 parts by weight, the dispersed state of the toner composition is poor and the toner particles having the desired particle diameters are not obtained. When it exceeds 2,000 parts by weight, it is not economical. The dispersant can be used if necessary. It is preferable to use the dispersant because the particle size distribution becomes sharp and the dispersion is stable.

Various dispersants are used in order to emulsify or disperse an oil phase in which the toner composition has been dispersed in the liquid containing the water. Such a dispersant includes surfactants, inorganic fine particle dispersants and polymer fine particle dispersants.

The surfactants include anion surfactants such as alkylbenzene sulfonate salts, α-olefin sulfonate salts and phosphate salts, cation surfactants such as amine salt types such as alkylamine salts, amino alcohol fatty acid derivatives, polyamine fatty acid derivatives and imidazoline, and quaternary ammonium salt types such as alkyltrimethyl ammonium salts, dialkyldimethyl ammonium salts, alkyldimethylbenzyl ammonium salts, pyridinium salts, alkyl isoquinolinium salts and benzethonium chloride, nonionic surfactants such as fatty acid amide derivatives and polyvalent alcohol derivatives, and ampholytic surfactants such as alanine, dodecyldi(aminoethyl)glycine, di(octylaminoethyl)glycine and N-alkyl-N, N-dimethylammonium betaine.

By using the surfactant having fluoroalkyl group, it is possible to achieve the effect in an extremely small amount. The anionic surfactants having fluoroalkyl group preferably used include fluoroalkyl carboxylic acids having 2 to 10 carbon atoms and metal salts thereof, perfluorooctanesulfonyl disodium glutamate, 3-[omega-fluoroalkyl(C6 to C11)oxy]-1-alkyl(C3 to C4) sodium sulfonate, 3-[omega-fluoroalkanoyl (C6 to C8)-N-ethylamino]-1-propane sodium sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonic acids and metal salts thereof, perfluorooctane sulfonic acid diethanol amide, N-propyl-N-(2-hydroxyethyl)perfluoroactanesulfoneamide, perfluoroalkyl(C6 to C10)sulfoneamidepropyltrimethyl ammonium salts, perfluoroalkyl(C6 to C10)-N-ethylsulfonyl glycine salts and monoperfluoroalkyl(C6 to C16)ethyl phosphate esters.

Brand names includes Surflon S-111, S-112, S-113 (supplied from Asahi Glass Co., Ltd.), Fullard FC-93, FC-95, FC-98, FC-129 (supplied from Sumitomo 3M Ltd.), Unidain DS-101, DS-102 (supplied from Daikin Industries, Ltd.), Megafac F-110, F-120, F-113, F-191, F-812, F-833 (supplied from Dainippon Ink And Chemicals, Incorporated), F-Top EF-102, 103, 104, 105, 112, 123A, 123B, 306A, 501, 201, 204 (supplied from Tohchem Products Co., Ltd.), Ftergent F-100, F-150 (supplied from Neos Corporation).

The cation surfactants include aliphatic primary, secondary or secondary amine acids, aliphatic quaternary ammonium salts such as perfluoroalkyl(C6 to C10)sulfonamide propyltrimethyl ammonium salts, aliphatic benzalkonium salts, benzethonium chloride, pyridinium salts and imidazolium salts, as the brand names, Surflon S-121 (supplied from Asahi Glass Co., Ltd.), Fullard FC-135 (supplied from Sumitomo 3M Ltd.), Unidain DS-202 (supplied from Daikin Industries, Ltd.), Megafac F-150, F-824 (supplied from Dainippon Ink And Chemicals, Incorporated), F-Top EF-132 (supplied from Tohchem Products Co., Ltd.) and Ftergent F-300 (supplied from Neos Corporation).

As water hardly-soluble inorganic compound dispersants, tricalcium phosphate, calcium carbonate, titanium oxide, colloidal silica and hydroxyapatite can be used.

It was confirmed that the fine particle polymer had the same effect as the inorganic dispersant. For example, MMA polymer fine particles 1 μm and 3 μm, styrene fine particles 5 μm and 2 μm, styrene-acrylonitrile fine particle polymer 1 μm (PB-200H [supplied from Kao Corporation], SGP [supplied from Soken], Technopolymer SB [supplied from Sekisui Chemical Co., Ltd.], SGP-3G [supplied from Soken], Micropearl [Sekisui Fine Chemical]) are included.

As the dispersant usable by combining with the above inorganic dispersant and fine particle polymer, dispersion liquid drops may be stabilized by polymer based protection colloid. For example, acids such as acrylic acid, methacrylic acid, α-cyanoacrylic acid, α-cyanomethacrylic acid, itaconic acid, crotonic acid, fumaric acid, maleic acid and maleic acid anhydride; or (meth)acrylic monomer having hydroxyl group, e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-hydroxypropyl acrylate, 3-chloro-hydroxypropyl methacrylate, diethylene glycol monoacrylate ester, diethylene glycol monomethacrylate ester, glycerine monoacrylate ester, glycerine monomethacrylate ester, N-methylol acrylamide and N-methylol methacrylamide; vinyl alcohol or ethers with vinyl alcohol, e.g., vinyl methyl ether, vinyl ethyl ether and vinyl propyl ether, or esters of compounds containing vinyl alcohol and carboxyl group, e.g., vinyl acetate, vinyl propionate and vinyl butyrate; homopolymers or copolymers of those having nitrogen atoms or heterocycle thereof, e.g., acrylamide, methacrylamide, diacetone acrylamide or methylol compounds thereof, chlorides such as acrylic acid chloride and methacrylic acid chloride, vinyl pyridine, vinyl pyrrolidone, vinyl imidazole and ethylene imine; polyoxyethylene based compounds such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ether and polyoxyethylene nonylphenyl ester; and celluloses such as methylcellulose, hydroxyethylcellulose and hydroxypropylcellulose and the like can be used.

The toner particles altered in shapes can be made by stirring and constringing the resulting emulsified dispersion (reactant) at constant temperature range lower than the resin glass transition point at concentration range of the organic solvent to make the connate particles, then, gradually raising the temperature of the entire system with stirring laminar flow to remove the organic solvent, and performing desolvent. When the compound such as calcium phosphate salt which is soluble in acid or alkali is used as the dispersion stabilizer, the calcium phosphate salt is removed from the fine particles by dissolving the calcium phosphate salt in the acid such as hydrochloric acid and then washing with water. In addition, the salt can also be removed by decomposition with an enzyme.

When the dispersant is used, the dispersant can remain on the surface of the toner particle.

Furthermore, in order to reduce the viscosity of the dispersion containing the toner composition component, it is possible to use the solvent in which polyester such as urea-modified polyester and prepolymer (A) is soluble. It is preferable to use the solvent because the particle size distribution becomes sharp.

The solvent preferably has the boiling point of less than 100° C. and is volatile in terms of easy removal thereof. As the solvent, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone can be used alone or in combination of two or more. In particular, aromatic solvents such as toluene and xylene, and halogenated hydrocarbon such as methylene chloride, 1,2-dichloroethane, chloroform and carbon tetrachloride are preferable. The amount of the solvent to be used is typically 0 parts to 300 parts, preferably 0 parts to 100 parts and more preferably 25 parts to 70 parts relative to 100 parts of the prepolymer (A). When the solvent is used, the solvent is removed from the reactant under atmospheric pressure or reduced pressure after the extending and/or crosslinking reaction of modified polyester (prepolymer) with amine.

A reaction time of the extending and/or crosslinking reaction is selected, for example, depending on the reactivity by combination of the isocyanate group structure in the prepolymer (A) with amines (B), is typically 10 minutes to 40 hours and preferably 2 hours to 24 hours. A reaction temperature is typically 0° C. to 150° C. and preferably 40° C. to 98° C. The publicly known catalyst can be used if necessary. Specifically, dibutyl tin laurate and dioctyl tin laurate are included. As the extending agent and/or the crosslinking agent, the aforementioned amines (B) is used.

In the present invention, prior to the desolvent from the dispersion (reaction solution) after the extending and/or crosslinking reaction, it is preferable that the connate particles are made by stirring and constringing the dispersion at constant temperature range lower than the resin glass transition point at concentration range of the organic solvent, the shape is confirmed, and subsequently the desolvent is performed at 10° C. to 50° C. The toner is altered in shape by stirring the liquid before the removal of the solvent. This condition is not the absolute condition, and it is necessary to appropriately select the condition. When the concentration of the organic solvent contained during the granulation is high, by reducing the viscosity of the emulsified liquid, the particle shape easily becomes spherical when liquid drops are integrated. When the concentration of the organic solvent contained during the granulation is low, the viscosity of the liquid drops is high and the liquid drops do not form complete one particle to remove. Thus, it is necessary to set the optimal condition, and the toner shape can be appropriately controlled by selecting the condition. Furthermore, it is possible to control the shape by the content of the organically exchanged layered inorganic material. It is preferable that the organically exchanged layered inorganic material is contained at 0.05% to 10% in the solution or the dispersion in terms of solid. When its content is less than 0.05%, the target viscosity of the oil phase is not obtained and the target shape is not obtained. Because of low viscosity of the liquid drops, even when the liquid drops are connated during stirring and constringing, the target connate particle is not obtained and the liquid drops becomes spherical. When it exceeds 10%, a production property is deteriorated, the viscosity of the liquid drops becomes too high, the connate particle is not obtained and further the fixing performance is deteriorated.

Meanwhile, the ratio Dv/Dn of the volume average particle diameter (DV) to the number average particle diameter (Dn) can be controlled by adjusting the water layer viscosity, the oil layer viscosity, properties of the resin fine particles and the amounts to be added. Dv and Dn can be controlled by adjusting the properties and the amounts of the resin fine particles to be added.

The toner of the present invention can be used as the two component developer. In this case, the toner could be used by combining with a magnetic carrier. The ratio of the toner to the carrier contained in the developer is preferably 1 part by weight to 10 parts by weight of the toner relative to 100 parts by weight of the carrier. As the magnetic carrier, iron powders, ferrite powders, magnetite powders and magnetic resin carriers having the particle diameter of about 20 μm to 200 μm which are known conventionally can be used. Coating materials include amino based resins, e.g., urea-formaldehyde resins, melamine resins, benzoguanamine resins, urea resins, polyamide resins and epoxy resins. Also, polyvinyl and polyvinylidene based resins, e.g., acryl resins, polymethyl methacrylate resins, polyacrylonitrile resins, polyvinyl acetate resins, polyvinyl alcohol resins, polyvinyl butyral resins, polystyrene based resin such as polystyrene resins and styrene acryl copolymer resins, halogenated olefin resins such as polyvinyl chloride, polyester based resins such as polyethylene terephthalate resins and polybutylene terephthalate resins, polycarbonate based resins, polyethylene resins, fluoro terpolymers such as polyvinyl fluoride resins, polyvinylidene fluoride, polytrifluoroethylene resins, polyhexafluoropropylene resins, copolymer of vinylidene fluoride and acryl monomer, copolymer of vinylidene fluoride and vinyl fluoride and terpolymer of tetrafluoroethylene and vinylidene fluoride and non-fluoride monomer, and silicone can be used. If necessary, conductive powders may be contained in the coating resin. As the conductive powder, metal powders, carbon black, titanium oxide, tin oxide and zinc oxide can be used. These conductive powders preferably have the average particle diameter of 1 μm or less. When the average particle diameter is larger than 1 μm, it becomes difficult to control electrical resistance.

The toner of the present invention can also be used as the one component magnetic toner not using the carrier or as the non-magnetic toner.

By using the toner of this invention, it is possible to perform the good cleaning.

The dry toner of the present invention is excellent in fixing property at low temperature, properly controls the charge, remains in a small amount after the transfer in the apparatus using the blade cleaning and gives the image with high quality and high resolution.

EXAMPLE

The present invention will be further described by the following Examples, but the present invention is not limited thereto. Hereinafter, "parts" indicates "parts by weight".

Example 1

In a reaction chamber equipped with a cooling tube, a stirrer and a nitrogen introducing tube, 229 parts of bisphenol A ethylene oxide 2 mol adduct, 529 parts of bisphenol A propylene oxide 3 mol adduct, 208 parts of terephthalic acid, 46 parts of adipic acid and 2 parts of dibutyl tin oxide were placed, and reacted at 230° C. for 8 hours under atmospheric pressure. Subsequently, the reaction was performed under reduced pressure of 10 mmHg to 15 mmHg for 5 hours. Then, 44 parts of trimetric acid anhydride was added to the reaction chamber and reacted at 180° C. under atmospheric pressure for 2 hours to synthesize unmodified polyester.

The resulting unmodified polyester resin had a number average molecular weight of 2,500, a weight average molecular weight of 6,700, a glass transition temperature of 43° C. and an acid value 25 mg KOH/g.

Water (1200 parts), 540 parts of carbon black Printex 35 (supplied from Degussa; DBP absorbed oil amount=42 mL/100 mg, pH 9.5) and 1200 parts of the unmodified polyester resin were mixed using Henschel mixer (supplied from Mitsui Mining Co., Ltd.). The resulting mixture was kneaded at 150° C. for 30 minutes using a two roller, extended by applying pressure and cooled, then pulverized by a pulverizer to prepare a master batch.

A reaction vessel equipped with a stirrer bar and a thermometer, 378 parts of the unmodified polyester, 110 parts of carnauba wax, 22 parts of salicylate metal complex E-84 (supplied from Orient Chemical Industries Ltd.) and 947 parts of ethyl acetate were placed, which was then heated up to 80° C., kept at 80° C. for 5 hours and cooled to 30° C. over one hour. Subsequently, 500 parts of the master batch and 500 parts of ethyl acetate were placed in the reaction vessel and mixed for one hour to yield a raw material solution.

The resulting raw material solution (1324 parts) was transferred to the reaction vessel, using an Ultraviscomill (supplied from Imex) of a bead mill, zirconia beads of 0.5 mm was filled at 80% by volume, three passes were performed under the condition of a liquid sending speed at 1 kg/hour and a disc peripheral speed of 6 m/second to disperse C.I. pigment red and carnauba wax to yield a wax dispersion.

Subsequently, 1324 parts of an ethyl acetate solution containing 65% by weight of the unmodified polyester resin was added to the wax dispersion. Then, 3 parts of a layered inorganic material montmorillonite (Clayton APA supplied from Southern Clay Products) in which at least a part had been modified with a quaternary ammonium salt having benzyl group was added to 200 parts of a dispersion obtained by performing one pass using Ultraviscomill under the same condition as the above, and stirred using T. K. Homodisper supplied from Tokushu Kika Kogyo Co. Ltd. for 30 minutes to yield a dispersion of toner materials.

The viscosity of the resulting dispersion of the toner materials was measured as follows.

Using a parallel type rheometer AR200 (supplied from DA Instruments Japan) comprising a parallel plate with a diameter of 20 mm, a gap was set to 30 μm, after adding a shearing force at a shearing speed of 30,000 second-1 at 25° C. to the dispersion of the toner materials, the viscosity (viscosity A) was measured when the shearing speed was changed from 0 second-1 to 70 seconds-1 for 20 seconds. Using the parallel type rheometer AR200, the viscosity (viscosity B) was measured when the shearing force was added at a shearing speed of 30,000 second-1 at 25° C. for 30 seconds to the dispersion of the toner materials. This result was shown in Table 1.

In a reaction vessel equipped with a cooling tube, a stirrer and a nitrogen introducing tube, 628 parts of bisphenol A ethylene oxide 2 mol adduct, 81 parts of bisphenol A propylene oxide 2 mol adduct, 283 parts of terephthalic acid, 22 parts of trimellitic acid and 2 parts of dibutyl tin oxide were added, and reacted at 230° C. for 8 hours under atmospheric pressure. Subsequently, the reaction was performed under reduced pressure of 10 mmHg to 15 mmHg for 5 hours to synthesize an intermediate polyester resin.

The resulting intermediate polyester resin had the number average molecular weight of 2,100, the weight average molecular weight of 9,500, the glass transition temperature of 55° C., the acid value of 25 mg KOH/g, and a hydroxyl value of 51 mg KOH/g.

Subsequently, in a reaction vessel equipped with a cooling tube, a stirrer and a nitrogen introducing tube, 410 parts of the intermediate polyester resin, 89 parts of isophorone diisocyanate and 500 parts of ethyl acetate were placed, and reacted at 100° C. for 5 hours to synthesize a prepolymer. The content of isocyanate in the resulting prepolymer was 1.53% by weight.

In a reaction vessel equipped with a stirrer bar and a thermometer, 170 parts of isophorone diamine and 75 parts of methyl ethyl ketone were placed, and reacted at 50° C. for 5 hours to synthesize a ketimine compound. The resulting ketimine compound had an amine value of 418 mg KOH/g.

In a reaction vessel, 749 parts of the dispersion of the toner materials, 115 parts of the prepolymer and 2.9 parts of the ketimine compound were placed, and mixed using a TK mode homomixer (supplied from Tokushu Kika) at 5,000 rpm for one minute to yield an oil phase mixture.

In a reaction vessel equipped with a stirrer bar and a thermometer, 683 parts of water, 11 parts of Eleminol RS-30 (sodium salt of sulfate ester of ethylene oxide adduct of methacrylic acid) (supplied from Sanyo Chemical Industries, Ltd.), 83 parts of styrene, 83 parts of methacrylic acid, 110 parts of butyl acrylate and 1 part of ammonium persulfate were placed, and stirred at 400 rpm for 15 minutes to yield a liquid emulsion. The liquid emulsion was heated up to 75° C. and reacted for 5 hours. Subsequently, 30 parts of an aqueous solution of 1% by weight ammonium persulfate was added, and the maturation was performed at 75° C. for 5 hours to prepare a resin particle dispersion.

(Particle Diameters and Distribution of Dispersed Particle's Diameters of Dispersoid Particles in Toner Material Liquid)

In the present invention, diameters of dispersoid particles and distribution of dispersed particle's diameters in the toner material liquid were measured using "Microtrack UPA-150" (supplied from Nikkiso), and analyzed using an analysis software, "Microtrack Particle Size Analyzer Ver. 10.1.3-016EE (supplied from Nikkiso). Specifically, the toner material liquid, then the solvent used for making the toner material liquid were added in a 30 mL sample bottle made from glass to prepare a 10% by mass dispersion. The resulting dispersion was treated using "Ultrasonic dispersing device W-113 MK-II" (supplied from Honda Electronics Co., Ltd.) for 2 minutes.

Using the solvent used for making the toner material liquid, a background value was measured, then the dispersion was dropped, and the dispersed particle's diameter was measured under the condition so that values of sample loading in the device is in the range of 1 to 10. In the present measurement method, it is important to measure under the condition so that values of sample loading in the device is in the range of 1 to 10 in terms of measurement reproducibility of the dispersed particle's diameter. In order to obtain the value of the sample loading, it is necessary to adjust the amount of the dispersion to be dropped.

Measurement and analysis conditions were set as follows: Distribution display: volume, particle diameter division selection: standard, number of channels: 44, measurement time: seconds, measurement number: once, particle permeability: permeable, particle shape: non-spherical, density: 1 g/cm$^3$ As the value of the refraction index of the solvent, the value for the solvent used for the toner material liquid among the values described in "Guideline for input conditions upon measurement" published by Nikkiso was used.

Water (990 parts), 83 parts of the resin particle dispersion, 37 parts of Eleminol MON-7 (supplied from Sanyo Chemical Industries, Ltd.), an aqueous solution of 48.5% by weight of dodecyldiphenyl ether sodium disulfonate, 135 parts of Serogen BS-H-3 (supplied from Daiichi Kogyo Seiyaku Co., Ltd.), an aqueous solution of 1% by weight of a polymer dispersant, sodium carboxymethylcellulose and 90 parts of ethyl acetate were mixed and stirred to yield a water-based medium.

The oil phase mixture (867 parts) was added to 1200 parts of the water-based medium, which was then mixed at 3000 rpm using the TK mode homomixer for 20 minutes to prepare a dispersion (emulsified slurry).

Subsequently, in a reaction vessel equipped with a stirrer bar and a thermometer, the emulsified slurry was placed, desolvent was performed at 30° C. for 8 hours and the maturation was performed at 45° C. for 4 hours to yield a dispersion slurry.

The volume average particle diameter (Dv) and the number average particle diameter (Dn) of the toner of the present invention were measured suing a particle size measuring device, "Multisizer III" supplied from Beckman Coulter at an aperture diameter of 100 μm, and analyzed by analysis software (Beckman Coulter Multisizer 3 Version 3.51). Specifically, 0.5 mL of 100% by weight of the surfactant (alkylbenzene sulfonate salt, Neogen SC-A: supplied from Daiichi Kogyo Seiyaku Co., Ltd.) was added to a 100 mL beaker made from glass, then 0.5 g of each toner was added and mixed using a microspatula, and 80 mL of ion-exchange water was added. The resulting dispersion was treated using "Ultrasonic dispersing device W-113 MK-II" (supplied from Honda Electronics Co., Ltd.) for 10 minutes. The dispersion was measured using the Multisizer III and using Isoton III (supplied from Beckman Coulter) as the solution for measurement. The toner sample dispersion was dropped so that the concentration in the device indicated 8±2% in the measurement. In the present measurement method, it is important to make the concentration 8±2% in terms of measurement reproducibility. No error is produced in the particle diameter in this range.

The dispersion slurry (100 parts by weight) was filtrated under reduced pressure, subsequently 100 parts of ion-exchange water was added to a filtration cake, and mixed at 12,000 rpm using the TK mode homomixer for 10 minutes. Hydrochloric acid (10% by weight) was added to the resulting filtration cake to adjust pH to 2.8, and mixed at 12,000 rpm using the TK mode homomixer for 10 minutes, and then filtrated.

The ion-exchange water (300 parts) was added to the further resulting filtration cake, and mixed at 12,000 rpm using the TK mode homomixer for 10 minutes, and this was repeated to obtain a final filtration cake.

The resulting final filtration cake was dried using a shield type dryer at 45° C. for 48 hours and sieved with mesh having openings of 75 μm to yield toner base particles.

Hydrophobic silica (1.0 part) and hydrophobic titanium oxide (0.5 parts) as externally added agents were added to 100 parts of the resulting toner base particles, and mixed using Henschel mixer (supplied from Mitsui Mining Co., Ltd.) to produce the toner.

Example 2

The toner was produced in the same way as in Example 1, except that the amount of the exchanged layered inorganic material (brand name: Clayton APA) to be added was changed from 3 parts to 0.1 parts.

Example 3

The toner was produced in the same way as in Example 1, except that Clayton APA was changed to a layered inorganic material montmorillonite (Clayton HY supplied from Southern Clay Products) in which at least a part had been modified with an ammonium salt having polyoxyethylene group.

Example 4

The toner was produced in the same way as in Example 1, except that the amount of Clayton APA to be added was changed from 3 parts to 1.4 parts.

Example 5

The toner was produced in the same way as in Example 1, except that the amount of Clayton APA to be added was changed from 3 parts to 4 parts.

Example 6

The toner was produced in the same way as in Example 1, except that the amount of Clayton APA to be added was changed from 3 parts to 6 parts.

Example 7

Preparation of Colorant Dispersion (1)

| | |
|---|---|
| Carbon black (supplied from Degussa: Printex 35) | 125 parts |
| Ajisper PB821 (supplied from Ajinomoto Fine Techno) and | 18.8 parts |
| ethyl acetate (supplied from Wako Pure Chemical Industries Ltd.) | 356.2 parts |

were dissolved/dispersed using Ultraviscomill (supplied from Imex) to prepare a colorant dispersion (1) dispersing the colorant (black pigment).

(Preparation of Releasing Agent Dispersion)

—Preparation of Releasing Agent Dispersion (1) (Wax Component A)

| | |
|---|---|
| Carnauba wax (melting point: 83° C., acid value 8 mg KOH/g, saponification degree: 80 mg KOH/g) | 30 parts, |
| and | |
| ethyl acetate (supplied from Wako Pure Chemical Industries Ltd.) | 270 parts |

were wet-pulverized using Ultraviscomill (supplied from Imex) to prepare a releasing agent dispersion (1).

—Preparation of Layered Inorganic Material Exchanged with Organic Cation (Shape-Altering Agent Dispersion A)

| | |
|---|---|
| Clayton APA (supplied from Southern Clay Products) | 30 parts |
| and | |
| ethyl acetate (supplied from Wako Pure Chemical Industries Ltd.) | 270 parts |

were wet-pulverized using Ultraviscomill (supplied from Imex) to prepare a shape-altering agent dispersion A.

Polyester (1)

| | |
|---|---|
| Polyester resin composed of bisphenol A propylene oxide adduct, bisphenol A ethylene oxide adduct and a terephthalic acid derivative (Mw 50,000, Mn 3,000, acid value mg KOH/g, hydroxyl value 27 mg KOH/g, Tg 55° C. and softening point 112° C.) | 350 parts |
| colorant dispersion (1) | 237 parts |
| shape altering agent dispersion A | 72 parts |
| releasing agent dispersion (1) | 304 parts |
| and | |
| hydrophobic silicon oxide fine particles (R972 supplied from Aerosil) | 17.8 parts |

were mixed and thoroughly stirred until being uniform (this solution was made the solution A).

Meanwhile, 100 parts of a calcium carbonate dispersion in which 40 parts of calcium carbonate particles had been dispersed in 60 parts of water and 200 parts of an aqueous solution of 1% Serogen BS-H (supplied from Daiich Kogyo Seiyaku Co., Ltd) and 157 parts of water were stirred using the TK Homodisper F model (supplied from Primix) (this solution was made the solution B). Furthermore, using the TK Homomixer Mark 2 F model (supplied from Primix), 345 parts of the solution B and 250 parts of the solution A were stirred at 10,000 rpm for 2 minutes to suspend the mixture, and subsequently stirred at room temperature at atmospheric pressure using a propeller-type stirrer for 48 hours to remove the solvent. Subsequently, hydrochloric acid was added to remove calcium carbonate, then the mixture was washed with water, dried and classified to yield the toner. The average particle diameter of the toner was 6.2 μm.

Example 8

Preparation of Resin Without Solvent

A monomer mixed solution in which 100 parts by weight of styrene and 0.7 parts by weight of di-tertiary-butyl-peroxide had been mixed uniformly was continuously added in 30 minutes into an autoclave comprising a stirrer controlled at 215° C. and a heating device and a cooling device, and kept for 30 minutes with keeping the temperature at 215° C. to yield a resin without solvent. The resulting resin without solvent had a molecular weight peak Mp of 4,150 and the weight average molecular weight Mw of 4,800.

(Preparation of Resin Emulsified Dispersion)

In a vessel equipped with a stirrer and a drop pump, 27 parts by weight of distilled water and one part by weight of the anionic emulsifier (brand name: Neogen SC-A supplied from Daiichi Kogyo Seiyaku Co., Ltd.) were placed, stirred and dissolved, and subsequently a monomer mixed solution composed of 75 parts by weight of styrene, 25 parts by weight of butyl acrylate and 0.05 parts by weight of divinyl benzene was stirred and dropped to yield a monomer emulsified dispersion.

Subsequently, in a pressure resistant reaction vessel equipped with a stirrer, a pressure indicator, a thermometer and a drop pump, 120 parts by weight of distilled water was placed, an inside thereof was replaced with nitrogen, then the temperature was raised to 80° C., 5% by weight of the above monomer emulsified dispersion was added to the pressure resistant reaction vessel, further 1 part by weight of an aqueous solution of 2% by weight potassium persulfate was added thereto to perform an initial polymerization at 80° C. After the completion of the initial polymerization, the temperature was raised up to 85° C., the remaining monomer emulsified dispersion and 4 parts of 2% by weight potassium persulfate were added over 3 hours, subsequently, kept at the same temperature to yield a styrene based resin emulsified solution with a particle diameter of 15 μm and a solid concentration of 40%. The resulting resin emulsified dispersion had a high polymerization conversion rate and can be stably polymerized. As a result of separating the resin by centrifuging the resin emulsified dispersion and analyzing the molecular weights, the weight average molecular weight Mw was 950,000 and the molecular weight peak Mp was 700,000.

Using a continuous kneader (brand name: KRC kneader supplied from Kurimoto Ltd.), 100 parts by weight of the resin without solvent and 135 parts by weight of the resin emulsified dispersion were continuously mixed and water was removed by heating at a jacket temperature of 215° C. to yield an evaporation dehydrated kneaded product in which the water content was 0.1% or less. The content of the residual monomer in the resulting evaporation dehydrated kneaded product was 80 ppm. After cooling, the evaporation dehydrated kneaded product was roughly pulverized using a hammer mill, and then finely pulverized using a jet mill to yield a styrene acryl resin (1).

The manipulation was performed in the same way as in Example 7, except that polyester (1) in Example 7 was changed to the styrene acryl resin (1).

Example 9

$Na_3PO_4$ (5 parts by mass) was introduced in 500 parts by mass, which was then heated at 60° C., and subsequently stirred using a Clearmix high speed stirrer (supplied from M technique, peripheral speed 22 m/s). An aqueous solution in which 2 parts by mass of $CaCl_2$ had been dissolved in 15 parts by mass of the ion-exchange water was quickly added thereto to yield a water-based medium containing $Ca_3(PO_4)_2$.

| | |
|---|---|
| Polymerizable monomer styrene | 85 parts by mass |
| n-Butyl acrylate | 20 parts by mass |
| Colorant C.I. pigment blue 15:3 | 7.5 parts by mass |

-continued

| | |
|---|---|
| Charge controlling agent (supplied from Orient Chemical Industries Ltd.) | 1 part by mass |
| Polar resin, saturated polyester (acid value 10 mg KOH/g, peak molecular weight 7,500) | 5 parts by mass |
| Releasing agent, ester wax (maximum exothermic peak temperature in DSC, 72° C.) | 15 parts by mass |
| Clayton APA (supplied from Southern Clay Products) | 15 parts by mass |

Meanwhile, the above materials were heated at 60° C., stirred and respective materials were dissolved or dispersed uniformly in the polymerizable monomer. 2,2'-Azobis(2,4-dimethylvaleronitrile as a polymerization initiator was added thereto to prepare a polymerizable monomer composition.

The polymerizable monomer composition was introduced into the water-based medium, which was subsequently stirred at 60° C. under nitrogen atmosphere for 15 minutes using the Clearmix high speed stirrer (supplied from M technique, peripheral speed 22 m/s) to generate particles of the polymerizable monomer composition in the water-based medium. After dispersion, the stirrer was stopped, and the composition was introduced in an apparatus for polymerization comprising a full zone stirring wing (supplied from Shinko Pantec). The polymerizable monomer was reacted at 60° C. under nitrogen atmosphere for 5 hours with stirring the stirring wing at a maximum peripheral speed of 3 m/s in the polymerization apparatus 11. Subsequently, the temperature was raised to 80° C., and the polymerizable monomer was further reacted for 5 hours. After terminating the polymerization reaction, the product was washed, dried and classified to yield the toner. The average particle diameter of the toner particles was 5.8 μm.

Comparative Example 1

The toner was produced in the same way as in Example 1, except that Clayton APA (supplied from Southern Clay Products) was not added.

Comparative Example 2

The toner was produced in the same way as in Example 1, except that the amount of Clayton APA (supplied from Southern Clay Products) was changed to MEK-ST-UP (Nissan Chemical Industries, Ltd.).

Comparative Example 3

The toner was produced in the same way as in Example 1, except that Clayton APA (supplied from Southern Clay Product was changed to non-exchanged layered inorganic material montmorillonite (brand name: Kunipia supplied from Kunimine Industries Co., Ltd.).

Comparative Example 4

In 1300 parts of ion exchange water, 100 parts by hydrotalcite compound represented by the following formula A and 4 parts of an anionic surfactant (Neogen SC-A supplied from Daiichi Kogyo Seiyaku Co., Ltd.) were placed and emulsified and dispersed using T.K. homomixer MARKII2.5 (supplied from Primix). Subsequently, the mixture was heated to 130° C. and pressurized at 500 kg/cm$^2$ in PANDA 2K type which was operated for 30 minutes. Then, the mixture was cooled and removed to yield a layered inorganic material A dispersion. This was dried under reduced pressure to eliminate the water to yield a layered inorganic material A.

The toner was produced in the same way as in Example 1, except that Clayton APA (supplied from Southern Clay Product was changed to the layered inorganic material A.

$$Mg_{0.7}Al_{0.3}(OH)_2(CO_3)_{0.15}.0.57H2O \qquad \text{Formula A:}$$

Comparative Example 5

Synthesis Example of Polyester Resin

Terephthalic acid (TPA) and isophthalic acid (IPA) as bivalent carboxylic acids, polyoxypropylene(2.4)-2,2-bis(4-hydroxyphenyl)propane (BPA-PO) and polyoxyethylene(2.4)-2,2-bis(4-hydroxydiphenyl)propane (BPA-EO) as aromatic diol, and ethylene glycol (EG) as aliphatic diol were used in composition ratios shown in Table 2, 0.3% by weight of tetrabutyl titanate as a polymerization catalyst was added to all monomers in a separable flask, and reacted in the flask equipped with a thermometer, a stirring bar, a condenser and a nitrogen introducing tube in an electric heating mantle heater under nitrogen flow at atmospheric pressure at 220° C. for 15 hours, and the pressure was sequentially reduced and the reaction was continued at 10 mmHg. The reaction was followed up by a softening point in accordance with ASTM E28-517, and the reaction was terminated by stopping vacuum when the softening point became the given temperature to yield a linear polyester resin A. The composition and physical property values (property values) of the synthesized resin are shown.

TABLE 2

| | | |
|---|---|---|
| TPA | [mol %] | 34 |
| IPA | [mol %] | 9 |
| BPA-PO | [mol %] | 20.5 |
| BPA-EO | [mol %] | 12.5 |
| EG | [mol %] | 24 |
| T½ | [° C.] | 105 |
| acid value | [KOHmg/g] | 7.2 |
| Tg | [° C.] | 56 |
| Mw | | 6200 |

Preparation Example of Releasing Agent and Releasing Agent Dispersion

Purified carnauba wax No. 1 (supplied from CERARICA NODA Co., Ltd.) (105 parts), 45 parts of the polyester resin A and 280 parts by 0.5 mm zirconia beads in methyl ethyl ketone were placed in a bead mill (DynoMill supplied from Shinmaru Enterprises), dispersed for 2 hours, subsequently removed from the mill, and a solid content was adjusted to 20% by weight to yield a fine dispersion of a releasing agent.

Preparation Example of Colorant Dispersion

A colorant C.I.PIGMENT RED 57:1 ; Symuler Brilliant Carmin 6B 285 (supplied from Dainippon Ink And Chemicals, Incorporated), the resin and 0.5 mm zirconia beads in methyl ethyl ketone adjusted the solid content to 35% to 50% were placed in the bead mill (DynoMill supplied from Shinmaru Enterprises), dispersed for 2 hours, subsequently removed from the mill, and the solid content was adjusted to 20% by weight to yield a colorant dispersion.

—Dispersion of Layered Inorganic Material—

A layered inorganic material montmorillonite (15 parts) (Clayton APA supplied from Southern Clay Products) in which at least a part had been modified with a quaternary ammonium salt having benzyl group was dispersed in 135 parts of methyl ethyl ketone, and placed with 0.5 mm zirconia beads in bead mill (DynoMill supplied from Shinmaru Enterprises), dispersed for 2 hours, subsequently removed from the mill, and the solid content was adjusted to 20% by weight to yield a dispersion of the layered inorganic material.

—Preparation of Oil Phase—

The above colorant dispersion, polyester resin and methyl ethyl ketone were mixed using Homodisper (supplied from Primix), and the solid content was adjusted to 50% to make an oil phase.

The above oil phase (600 parts), 100 parts of the releasing agent dispersion, 15 parts of the layered inorganic material dispersion, 57.5 parts of methyl ethyl ketone, 29.0 parts of isopropyl alcohol as a phase inversion accelerator and 25.8 parts of an aqueous solution of ammonia were placed in a cylindrical vessel and stirred thoroughly. Subsequently, 230 parts of water is added, and a liquid temperature was made 30° C., and then the phase inversion emulsification was performed by dripping 44 parts of water with stirring. A peripheral velocity at that time was 1.2 m/s. After continuing the stirring for 30 minutes, the rotation was reduced, and 400 parts of water was added.

Then, the solvent was eliminated by distillation under reduced pressure, and washing with water was performed by filtration. Subsequently, a resulting wet cake was redispersed in water, an aqueous solution of 1 N hydrochloric acid was added until pH of the dispersion became about 4, and subsequently the washing with water was performed by filtration. The wet cake obtained in this way was lyophilized and classified using a gas flow system classifying devise to yield toner particles having the volume average particle diameter of 6.5 μm and an average circularity of 0.978.

Results of the evaluations of the above toners are shown in Table 1

TABLE 1

| | Volume average particle diameter | Number average particle diameter | Particle size distribution | Average circularity | SF1 |
|---|---|---|---|---|---|
| Example 1 | 5.1 | 4.9 | 1.04 | 0.947 | 151 |
| Example 2 | 4.6 | 4.3 | 1.07 | 0.958 | 128 |
| Example 3 | 5.5 | 5.0 | 1.10 | 0.953 | 133 |
| Example 4 | 5.8 | 5.2 | 1.12 | 0.950 | 138 |
| Example 5 | 5.2 | 4.8 | 1.08 | 0.938 | 158 |
| Example 6 | 5.9 | 5.2 | 1.13 | 0.927 | 195 |
| Example 7 | 6.2 | 5.0 | 1.24 | 0.958 | 128 |
| Example 8 | 5.7 | 4.7 | 1.21 | 0.964 | 131 |
| Example 9 | 5.8 | 4.4 | 1.32 | 0.961 | 130 |
| Comparative Example 1 | 6.8 | 5.6 | 1.21 | 0.962 | 110 |
| Comparative Example 2 | 4.8 | 4.3 | 1.12 | 0.958 | 128 |
| Comparative Example 3 | 5.8 | 4.4 | 1.32 | 0.981 | 128 |
| Comparative Example 4 | 5.4 | 4.7 | 1.15 | 0.982 | 112 |
| Comparative Example 5 | 6.5 | 5.1 | 1.28 | 0.978 | 124 |

| | Cleaning property | | | | |
|---|---|---|---|---|---|
| | Initial | 1,000 sheets | 100,000 sheets | Fixing property at low temperature | Hot offset |
| Example 1 | B | B | B | A | A |
| Example 2 | B | B | B | B | A |
| Example 3 | B | B | B | B | A |
| Example 4 | B | B | B | A | A |
| Example 5 | B | B | B | A | A |
| Example 6 | B | B | B | A | B |
| Example 7 | B | B | B | B | A |
| Example 8 | B | B | B | C | A |
| Example 9 | B | B | B | B | A |
| Comparative Example 1 | D | N.E. | N.E. | B | D |
| Comparative Example 2 | D | N.E. | N.E. | D | C |
| Comparative Example 3 | B | B | B | E | A |
| Comparative Example 4 | D | N.E. | N.E | A | A |
| Comparative Example 5 | D | N.E. | N.E | D | C |

N.E: unable to evaluate

From these results, it is found that the toners in Examples are excellent in cleaning property from an initial phase to over a long term. The toner of Comparative Example 1 caused cleaning defect in the initial phase, and could not be evaluated over a long term.

(Evaluation Methods and Evaluation Results of Toners)

Concerning the toners obtained, the volume average particle diameter Dv, the number average particle diameter Dn, the particle size distribution Dv/Dn, the average circularity, the shape figure SF1 and the cleaning property were measured as follows. Dv and Dn were measured using the particle size analyzer, Multisizer III (supplied from Beckman Coulter) at an aperture diameter of 100 μm. Dv/Dn was calculated from the obtained results.

In the present invention, a flow type particle image analyzer (FPIA-2100 supplied from Sysmex) was used for measuring the ultrafine toner, and the analysis was performed using the analysis software (FPIA-2100 DataProcessing Program for FPIA version 00-10). Specifically, 0.1 mL to 0.5 mL of 10% by weight of the surfactant (alkylbenzene sulfonate salt, Neogen SC-A: supplied from Daiichi Kogyo Seiyaku Co., Ltd.) was added to a 100 mL beaker made from glass, then 0.1 g to 0.5 g of each toner was added and mixed using a microspatula, and 80 mL of ion-exchange water was added. The resulting dispersion was treated using the Ultrasonic dispersing device (supplied from Honda Electronics Co., Ltd.) for 3 minutes. Using the FPIA-2100, the toner shape and its distribution were measured in the dispersion until obtaining the concentration of 5,000 particles/μL to 15,000 particles/μL. In the present measurement method, it is important that the concentration of the dispersion is 5,000 particles/μL to 15,000 particles/μL in terms of measurement reproducibility of the average circularity. In order to obtain the above concentration of the dispersion, it is necessary to change the condition of the dispersion, i.e., the amounts of the surfactant and the toner to be added. The amount of the surfactant to be required varies depending on the hydrophobicity of the toner as is the case with the measurement of the toner particle diameter. When the amount of the surfactant is large, noises due to foams occur. When it is small, the dispersion becomes insufficient because the surfactant can not wet the toner sufficiently. The amount of the toner to be added varies depending on the particle diameters. In the case of the small particle diameter, the small amount of the toner is required. In the case of the large particle diameter, the large amount of the toner is required. When the toner particle diameters are 3 μm to 7 μm, by adding 0.1 g to 0.5 g of the toner, it becomes possible to adjust the dispersion concentration to 5,000 particles/μL to 15,000 particles/μL.

SF1 was measured as follows. After depositing the toner, 100 or more toner particles were observed under the condition of accelerating voltage of 2.5 KeV using an ultrahigh resolution machine FE-SEM S-5200 (supplied from Hitachi Ltd.). Subsequently, SF1 was calculated using an image analyzer Luzex AP (supplied from Nicole) and the software for image processing.

The cleaning property was measured as follows. At the initial phase and after printing 1,000 sheets and 100,000 sheets, the toner left on the photoconductor passed through the cleaning step was transferred onto white paper using a Scotch tape (supplied from Sumitomo 3M Ltd.), and measured using a Macbeth reflection densitometer RD514 type. As a result, those showing the difference of 0.01 or less from a blank were determined as good "B", and those showing the difference of more than 0.01 were determined as bad "D".

The fixing property of the toner was measured as follows. In a remodeled machine (a) which was Imagio Neo 450 equipped with a belt heating fixing device shown in FIG. 1, the same evaluation was performed. A base substance of the belt was 100 μm of polyimide, an intermediate elastic layer was 100 μm of silicon rubber, an offset prevention layer on the surface was 15 μm of PFA, the fixing roller was a silicon foam, a metallic cylinder of a press roller was SUS with a thickness of 1 mm, the offset prevention layer of the press roller was PFA tube+silicon rubber whose thickness was 2 mm, a heating roller was aluminium with a thickness of 2 mm and a surface pressure was $1\times10^5$ Pa.

Criteria for Evaluating Each Property are as Follows (1) Fixing Property at Low Temperature (Five Scale Evaluation)

A: lower than 120° C., B: 120° C. to 130° C., C: 130° C. to 140° C., D: 140° C. to 150° C., and E: 150° C. or above.

(2) Hot Offset Property (Five Scale Evaluation)

A: 201° C. or above, B: 200° C. to 191° C., C: 190° C. to 181° C., D: 180° C. to 171° C. and E: 170° C. or below.

Degree (fixing lower limit temperature) and hot offset temperature (hot offset resistance temperature) were obtained. The fixing lower limit temperature of the conventional toner fixed at low temperature is about 140° C. to 150° C. The conditions for evaluating the fixing at low temperature were set to a line speed of 120 mm/sec to 150 mm/sec for paper feeding, the surface pressure of 1.2 Kgf/cm$^2$ and a nip width of 3 mm. In the condition for evaluating the high temperature offset, the line speed for paper feeding was 50 mm/sec, the surface pressure was 20 Kgf/cm$^2$ and the nip width was 4.5 mm.

The invention claimed is:

1. A toner producing method comprising granulating a toner by dispersing and/or emulsifying an oil phase in a water-based medium, making connate particles of the dispersed and/or emulsified oil phase, and then removing the solvent, wherein the oil phase contains, in an organic solvent, at least a binding resin and/or a binding resin precursor, a colorant, and an exchanged layered inorganic material wherein at least a part of interlayer ions in the layered inorganic material has been exchanged with organic ions, and wherein the toner has an average circularity of 0.925 to 0.970.

2. The toner producing method according to claim 1, wherein said exchanged layered inorganic material is a layered inorganic material in which at least a part of interlayer ions in the layered inorganic material has been exchanged with organic cations.

3. The toner producing method according to claim 1, wherein the binding resin contained in said toner contains at least two types of binding resins.

4. The toner producing method according to claim 3, wherein a first binding resin contained in said binding resin is a resin having a polyester skeleton.

5. The toner producing method according to claim 4, wherein the resin having a polyester skeleton is a polyester resin.

6. The toner producing method according to claim 5, wherein said polyester resin is an unmodified polyester resin.

7. The toner producing method according to claim 1, wherein said binding resin precursor is a modified polyester based resin.

8. The toner producing method according to claim 4, wherein the toner is granulated by dissolving or dispersing at least said first binding resin, said binding resin precursor, a compound extended or crosslinked with said binding resin precursor, a colorant, a releasing agent and said exchanged layered inorganic material in an organic solvent, crosslinking and/or extending the above components contained in the solution or the dispersion in a water-based medium, making connate particles of dispersoid, and removing the solvent from a resulting dispersion.

9. The toner producing method according to claim 1, wherein a ratio (Dv/Dn) of a volume average particle diameter (Dv) to a number average particle diameter (Dn) is 1.00 to 1.30 and toner particles of an average circularity of 0.950 or less comprise 20% to 80% of entire toner particles.

10. The toner producing method according to claim 1, wherein the exchanged layered inorganic material is contained at 0.05% by weight to 10% by weight in a solid content in the oil phase.

11. The toner producing method according to claim 1, wherein the toner particles of 2 μm or less in diameter are 1% by number to 20% by number of the entire toner particles.

12. The toner producing method according to claim 4, wherein the content of a polyester resin component contained in said first binding resin is 50% by weight to 100% by weight.

13. The toner producing method according to claim 4, wherein a weight average molecular weight of a THF soluble fraction of said polyester resin component is 1,000 to 30,000.

14. The toner producing method according to claim 4, wherein an acid value of said first binding resin is 1.0 (KOH mg/g) to 50.0 (KOH mg/g).

15. The toner producing method according to claim 4, wherein a glass transition point of said first binding resin is 35° C. to 65° C.

16. The toner producing method according to claim 1, wherein said binding resin precursor has a site capable of reacting with a compound having an active hydrogen group and the weight average molecular weight of a polymer of said binding resin precursor is 3,000 to 20,000.

17. The toner producing method according to claim 1, wherein the acid value is 0.5 (KOH mg/g) to 40.0 (KOH mg/g).

18. The toner producing method according to claim 1, wherein the glass transition point is 40° C. to 70° C.

19. The toner producing method according to claim 1, wherein the connate particles are made by stirring and constringing resulting an emulsified dispersion at constant temperature range lower than the resin glass transition point at concentration range of the organic solvent.

20. The toner producing method according to claim 8, wherein the connate particles are made by stirring and constringing the dispersion at constant temperature range lower than the resin glass transition point at concentration range of the organic solvent.

* * * * *